US011158266B2

(12) United States Patent
Baek et al.

(10) Patent No.: US 11,158,266 B2
(45) Date of Patent: Oct. 26, 2021

(54) DISPLAY DEVICE AND DRIVING METHOD THEREOF

(71) Applicant: Samsung Display Co., Ltd., Yongin-si (KR)

(72) Inventors: Sung-Yeol Baek, Anyang-si (KR); Weon Jun Choe, Hwaseong-si (KR); Kwang Suk Shin, Anyang-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/401,083

(22) Filed: May 1, 2019

(65) Prior Publication Data

US 2019/0371250 A1 Dec. 5, 2019

(30) Foreign Application Priority Data

Jun. 5, 2018 (KR) ..... 10-2018-0064848

(51) Int. Cl.
*G09G 3/3291* (2016.01)

(52) U.S. Cl.
CPC ..... *G09G 3/3291* (2013.01); *G09G 2310/027* (2013.01); *G09G 2320/0247* (2013.01); *G09G 2320/064* (2013.01); *G09G 2320/0673* (2013.01)

(58) Field of Classification Search
CPC ..... G09G 3/3291; G09G 2310/027; G09G 2320/0247; G09G 2320/064; G09G 2320/0673
See application file for complete search history.

(56) References Cited

U.S. PATENT DOCUMENTS

| | | | | |
|---|---|---|---|---|
| 9,182,643 | B1 * | 11/2015 | Ge | G02F 1/13624 |
| 9,858,854 | B2 | 1/2018 | Seo et al. | |
| 2007/0182700 | A1 * | 8/2007 | Baba | G09G 3/20 345/102 |
| 2017/0069256 | A1 * | 3/2017 | Seo | G09G 3/3648 |
| 2018/0061364 | A1 | 3/2018 | Cook et al. | |

FOREIGN PATENT DOCUMENTS

| | | |
|---|---|---|
| JP | 2007-206651 | 8/2007 |
| KR | 10-1651291 | 8/2016 |
| KR | 10-2017-0028479 | 3/2017 |

* cited by examiner

*Primary Examiner* — Robert J Michaud
(74) *Attorney, Agent, or Firm* — H.C. Park & Associates, PLC

(57) ABSTRACT

A display device includes a frame frequency detector, a data generator, a data driver, and a plurality of pixels. The frame frequency detector is configured to detect a varied frame frequency to generate frame frequency information. The data generator is configured to receive an image signal and the frame frequency information, confirm an expanded frame period exceeding a reference frame period in one frame from the frame frequency information, and correct an image data signal corresponding to the image signal to correspond to a luminance changed according to the expanded frame period. The data driver is configured to output a data voltage corresponding to the image data signal. The plurality of pixels is configured to emit luminance corresponding to the data voltage. The reference frame period is a period in which the plurality of pixels is configured to emit light with a constant luminance corresponding to the data voltage.

19 Claims, 17 Drawing Sheets

DISPLAY DEVICE AND DRIVING METHOD THEREOF

CROSS-REFERENCE TO RELATED APPLICATION

This application claims priority from and the benefit of Korean Patent Application No. 10-2018-0064848, filed Jun. 5, 2018, which is hereby incorporated by reference for all purposes as if fully set forth herein.

BACKGROUND

Field

Exemplary embodiments generally relate to a display device and a driving method thereof, and, more particularly, to a display device in which a frame frequency is varied, and a driving method thereof.

Discussion

A display device may use a light emitting diode (LED) of which luminance is controlled by a current or a voltage. The LED may include an anode layer and a cathode layer forming an electric field, and an emission layer configured to emit light in accordance with the electric field. A pixel of the display device may include an LED, a driving transistor controlling a current amount supplied to the LED, and a switching transistor transmitting a data voltage to the driving transistor. It is noted that the display device typically displays frame images of a number corresponding to a frame frequency per second. The display device may display a plurality of frame images with a predetermined frame frequency, or a plurality of frame images corresponding to the frame frequency that is varied.

The display device may further include a display unit including a plurality of pixels and a signal controller driving the display unit. The signal controller displays the image via the display unit using an image signal and an input control signal that are usually applied (or received) from an external graphics processing device. The graphics processing device renders raw data to generate the image signal, and a rending time for generating the image signal corresponding to one frame may be varied according to a kind and a characteristic of the image. The signal controller may vary the frame frequency corresponding to the rendering time. When a length of one frame is long, a phenomenon in which the luminance of the image displayed in the display unit increases or decreases may be generated. A flicker in which a screen appears to flash due to these luminance changes may be recognized.

The above information disclosed in this section is only for understanding the background of the inventive concepts, and, therefore, may contain information that does not form prior art.

SUMMARY

Some exemplary embodiments provide a display device capable of improving display quality by preventing (or at least reducing) a flicker that may be generated depending on the variation of a frame frequency.

Some exemplary embodiments provide a method of driving a display device capable of improving display quality by preventing (or at least reducing) a flicker that may be generated depending on the variation of a frame frequency.

According to some exemplary embodiments, a display device includes a frame frequency detector, a data generator, a data driver, and a plurality of pixels. The frame frequency detector is configured to detect a varied frame frequency to generate frame frequency information. The data generator is configured to receive an image signal and the frame frequency information, confirm an expanded frame period exceeding a reference frame period in one frame from the frame frequency information, and correct an image data signal corresponding to the image signal to correspond to a luminance changed according to the expanded frame period. The data driver is configured to output a data voltage corresponding to the image data signal. The plurality of pixels is configured to emit luminance corresponding to the data voltage. The reference frame period is a period in which the plurality of pixels is configured to emit light with a constant luminance corresponding to the data voltage.

According to some exemplary embodiments, a display device includes plurality of pixels, a light emission control driver, a frame frequency detector, and a light emission control signal generator. The light emission control driver is configured to apply a light emission signal to the plurality of pixels. The frame frequency detector is configured to detect a varied frame frequency to generate frame frequency information. The light emission control signal generator is configured to receive the frame frequency information, confirm an expanded frame period exceeding a reference frame period in one frame from the frame frequency information, and adjust a luminance of the image by controlling a pulse width of the light emission signal in correspondence with the luminance that is changed according to the expanded frame period. The reference frame period is a period in which the plurality of pixels is configured to emit light with a constant luminance corresponding to an input data voltage.

According to some exemplary embodiments, a display device includes a frame frequency detector, a gamma voltage controller, a gamma voltage generator, a data generator, and a data driver. The frame frequency detector is configured to detect a varied frame frequency to generate frame frequency information. The gamma voltage controller is configured to receive the frame frequency information, confirm an expanded frame period exceeding a reference frame period in one frame from the frame frequency information, and generate a gamma voltage control signal in correspondence with a luminance that is changed according to the expanded frame period. The gamma voltage generator is configured to adjust a level of a reference gamma voltage according to the gamma voltage control signal. The data generator configured to receive an image signal, and generate a data voltage corresponding to the image data signal based on the reference gamma voltage. The reference frame period is a period in which the plurality of pixels is configured to emit light with a constant luminance corresponding to an input data voltage.

According to some exemplary embodiments, a method of driving a display device includes: determining whether a frame frequency is varied; determining, in response to the frame frequency being varied, whether a maximum brightness setting value setting luminance displayed in a display device corresponding to data of a maximum gray is greater than a predetermined reference brightness; and correcting, in response to the maximum brightness setting value being larger than the reference brightness, the luminance of an image by a data dimming method for correcting an image data signal corresponding to the luminance that is changed according to an expanded frame period exceeding a reference frame period in one frame.

According to various exemplary embodiments, a flicker otherwise generated in a conventional display device in which a frame frequency is varied may be prevented (or at least reduced), thereby improving display quality.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concepts, and are incorporated in and constitute a part of this specification, illustrate exemplary embodiments of the inventive concepts, and, together with the description, serve to explain principles of the inventive concepts.

DETAILED DESCRIPTION

Figure 1:
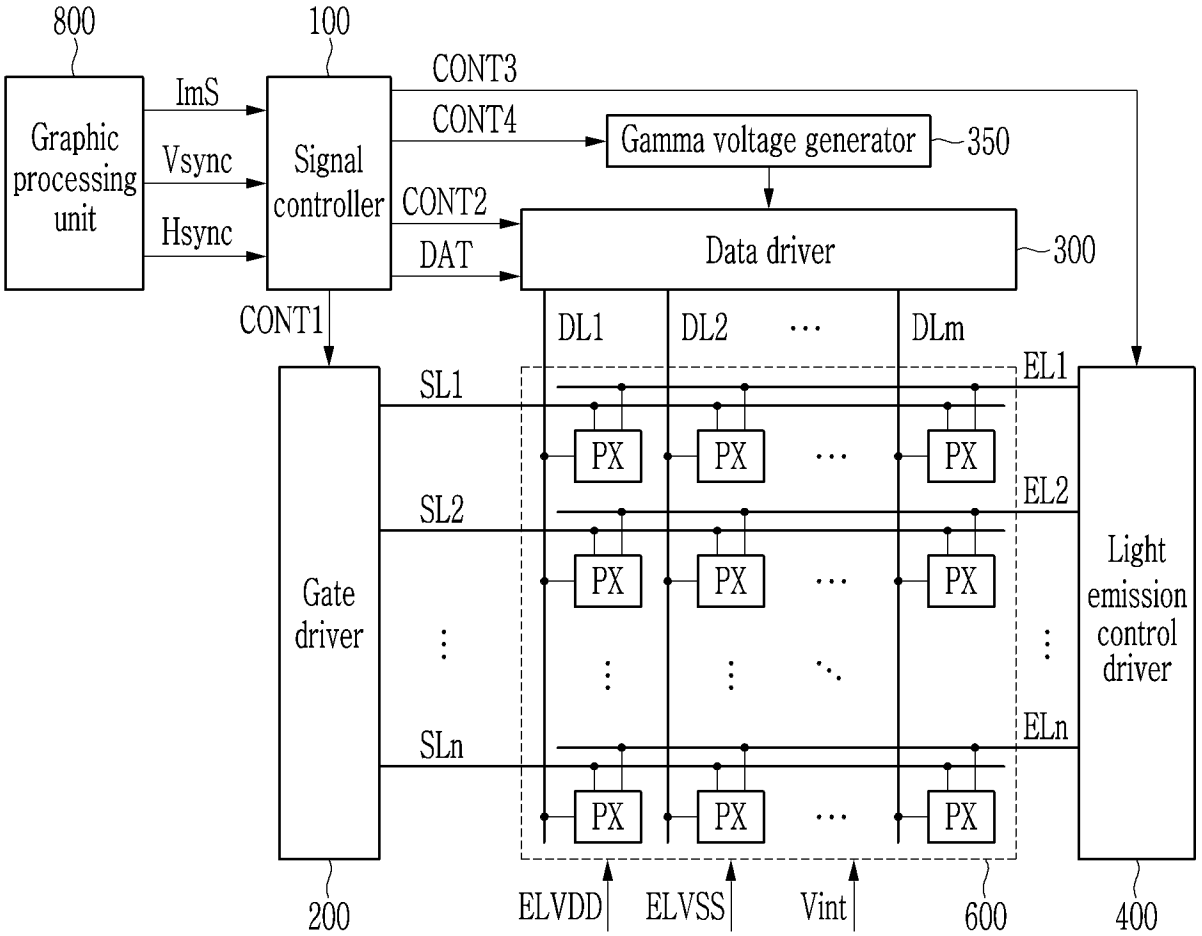
FIG. 1 is a block diagram showing a display device according to some exemplary embodiments.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some exemplary embodiments. Therefore, unless otherwise specified, the features, components, modules, layers, films, panels, regions, aspects, etc. (hereinafter individually or collectively referred to as an "element" or "elements"), of the various illustrations may be otherwise combined, separated, interchanged, and/or rearranged without departing from the inventive concepts.

In the accompanying drawings, the size and relative sizes of elements may be exaggerated for clarity and/or descriptive purposes. As such, the sizes and relative sizes of the respective elements are not necessarily limited to the sizes and relative sizes shown in the drawings. When an exemplary embodiment may be implemented differently, a specific process order may be performed differently from the described order. For example, two consecutively described processes may be performed substantially at the same time or performed in an order opposite to the described order. Also, like reference numerals denote like elements. To this end, one or more exemplary embodiments are representatively described, and in various other exemplary embodiments, only different configurations from the one or more exemplary embodiment will be described.

When an element is referred to as being "on," "connected to," or "coupled to" another element, it may be directly on, connected to, or coupled to the other element or intervening elements may be present. When, however, an element is referred to as being "directly on," "directly connected to," or "directly coupled to" another element, there are no intervening elements present. Other terms and/or phrases used to describe a relationship between elements should be interpreted in a like fashion, e.g., "between" versus "directly between," "adjacent" versus "directly adjacent," "on" versus "directly on," etc. Further, the term "connected" may refer to physical, electrical, and/or fluid connection. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one element's relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

As customary in the field, some exemplary embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some exemplary embodiments may be physically separated into two or more interacting and discrete blocks, units, and/or modules without departing from the inventive concepts. Further, the blocks, units, and/or modules of some exemplary embodiments may be physically combined into more complex blocks, units, and/or modules without departing from the inventive concepts.

Hereinafter, various exemplary embodiments will be explained in detail with reference to the accompanying drawings A display device according to some exemplary embodiments will be described with reference to FIGS. 1 to 4.

Figure 2:
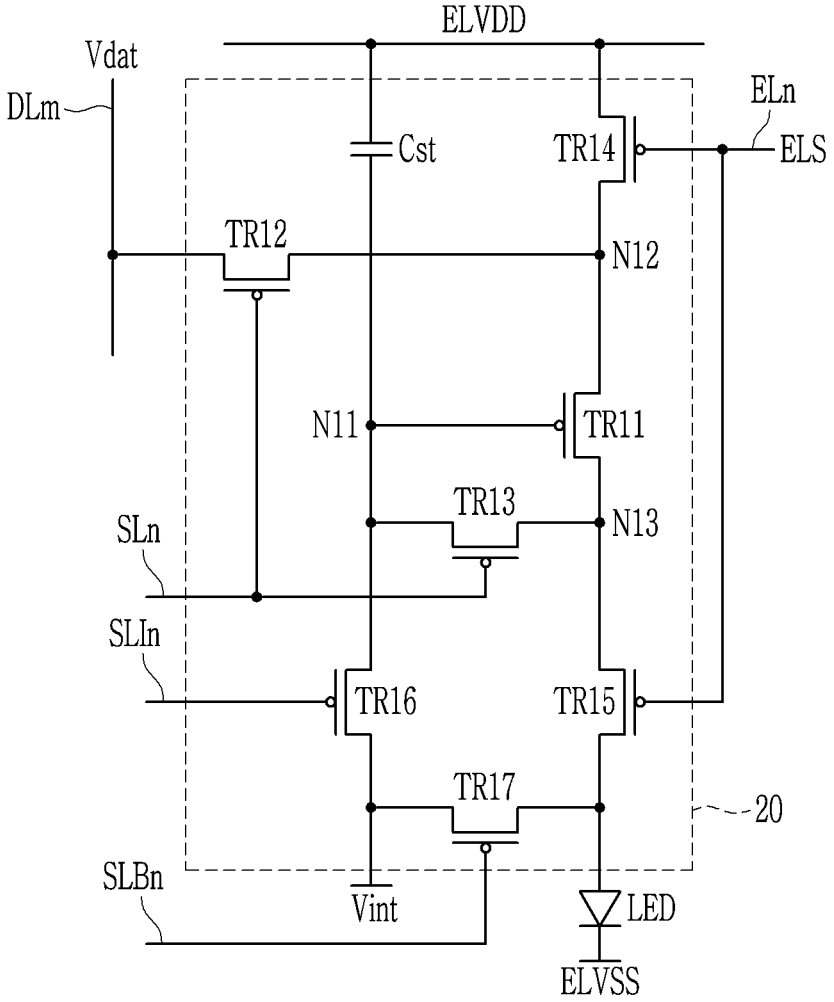
FIG. 2 is a view showing a pixel according to some exemplary embodiments.
Figure 3:
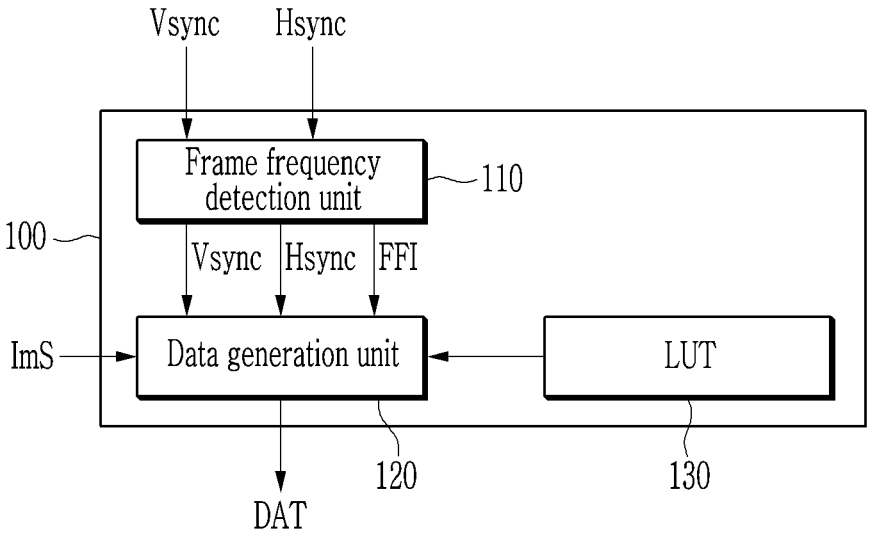
FIG. 3 is a block diagram showing a signal controller according to some exemplary embodiments.
Figure 4:
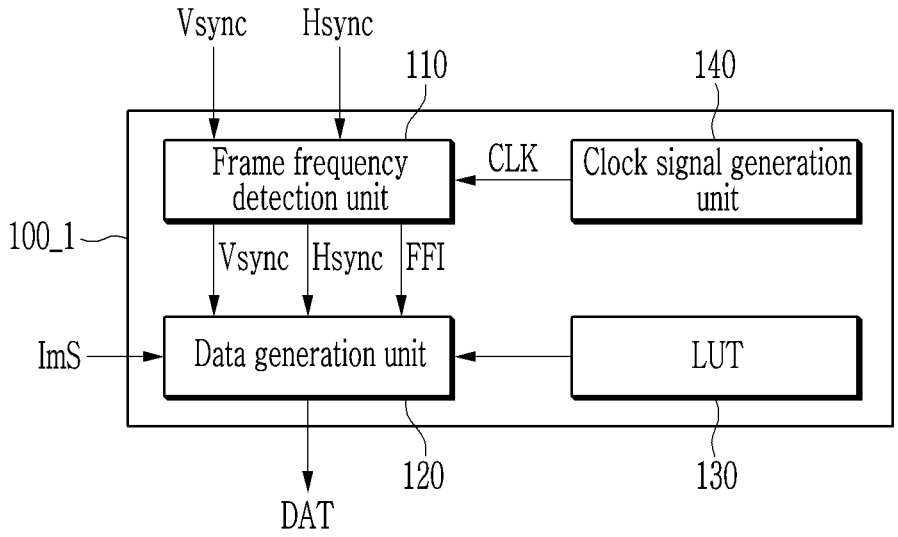
FIG. 4 is a block diagram showing a signal controller according to some exemplary embodiments.

FIG. 1 is a block diagram showing a display device according to some exemplary embodiments. FIG. 2 is a view showing a pixel according to according to some exemplary embodiments. FIG. 3 is a block diagram showing a signal controller according to some exemplary embodiments. FIG. 4 is a block diagram showing a signal controller according to some exemplary embodiments.

Referring to FIG. 1, a display device includes a signal controller 100, a gate driver 200, a data driver 300, a gamma voltage generator 350, a light emission control driver 400, a display unit 600, and a graphics processing unit (or graphics processor) 800.

The graphics processing unit 800 processes raw data using a method, such as a rendering, etc. method, to generate an image signal ImS and an input control signal controlling display of the image signal ImS. The image signal ImS contains luminance information of one or more (e.g., each) pixel PX, and the luminance includes a gray level of a predetermined value. The input control signal may include a vertical synchronization signal Vsync and a horizontal synchronizing signal Hsync.

The signal controller 100 receives the image signal ImS and the input control signal from the graphics processing unit 800. The signal controller 100 may divide the image signal ImS by a frame unit according to the vertical synchronization signal Vsync, and may divide the image signal ImS by a unit of gate lines SL1-SLn (where "n" is a positive integer greater than or equal to one) according to the horizontal synchronizing signal Hsync. The signal controller 100 may process the image signal ImS to be suitable for an operating condition of the display unit 600 and the data driver 300 based on the image signal ImS and the input control signal, and may generate an image data signal DAT, a gate control signal CONT1, a data control signal CONT2, a light emission control signal CONT3, and a gamma voltage control signal CONT4. The signal controller 100 transmits the gate control signal CONT1 to the gate driver 200. The signal controller 100 transmits the data control signal CONT2 and the image data signal DAT to the data driver 300. The signal controller 100 transmits the light emission control signal CONT3 to the light emission control driver 400. The signal controller 100 transmits the gamma voltage control signal CONT4 to the gamma voltage generator 350.

The signal controller 100 may detect a frame frequency to generate frame frequency information (referring to FFI of FIG. 3) using the vertical synchronization signal Vsync transmitted from the graphics processing unit 800. The signal controller 100 may generate the image data signal DAT so that a flicker is not generated corresponding to the varied frame frequency, and the detailed description thereof will be described later in association with FIG. 3. The signal controller 100 may control a light emission period of a plurality of pixels PX such that the flicker is not generated corresponding to the varied frame frequency, and the detailed description thereof will be described later in association with FIG. 9. The signal controller 100 may control a reference gamma voltage such that the flicker is not generated corresponding to the varied frame frequency, and the detailed description thereof will be described later in association with FIG. 14.

The display unit 600 includes a plurality of gate lines SL1 to SLn, a plurality of data lines DL1 to DLm (where "m" is a positive integer greater than or equal to one), a plurality of light emission control lines EL1 to ELn, and the plurality of pixels PX. The plurality of pixels PX are connected to the plurality of gate lines SL1 to SLn, the plurality of data lines DL1 to DLm, and the plurality of light emission control lines EL1 to ELn, and may be arranged in an approximate matrix shape. The plurality of gate lines SL1 to SLn may extend substantially in a row direction and may be substantially parallel with each other. The plurality of light emission control lines EL1 to ELn may extend substantially in a row direction and may be substantially parallel with each other. The plurality of data lines DL1 to DLm may extend substantially in a column direction and may be substantially parallel with each other.

A first power source voltage ELVDD, a second power source voltage ELVSS, and an initialization voltage Vint may be supplied to the display unit 600. The first power source voltage ELVDD may be a high level voltage provided to an anode of a light emitting diode (referring to LED of FIG. 2) included in each of the plurality of pixels PX. The second power source voltage ELVSS may be a low level voltage provided to a cathode of the light emitting diode LED included in each of the plurality of pixels PX. The first power source voltage ELVDD and the second power source voltage ELVSS are each a driving voltage for emitting light via the plurality of pixels PX. The initialization voltage Vint to initialize or reset the pixel PX may be a voltage of a different level from that of the second power source voltage ELVSS.

The gate driver 200 is connected to the plurality of gate lines SL1 to SLn, and applies a gate signal made of a combination of a gate-on voltage and a gate-off voltage to the plurality of gate lines SL1 to SLn according to the gate control signal CONT1. The gate driver 200 may sequentially apply the gate signal of the gate-on voltage to the plurality of gate lines SL1 to SLn.

The data driver 300 is connected to the plurality of data lines DL1 to DLm, samples and holds the image data signal DAT according to the data control signal CONT2, and applies the data voltage (referring to Vdat of FIG. 2) to the plurality of data lines DL1 to DLm. The data driver 300 may apply the data voltage Vdat having a predetermined voltage range to the plurality of data lines DL1 to DLm corresponding to the gate signal of the gate-on voltage.

The gamma voltage generator 350 provides the reference gamma voltage to the data driver 300. The gamma voltage generator 350 may adjust a level of the reference gamma voltage to the data driver 300 according to the gamma voltage control signal CONT4. The data driver 300 generates the data voltage Vdat corresponding to the image data signal DAT based on the reference gamma voltage. As the reference gamma voltage is adjusted, the voltage level of the data voltage Vdat may be adjusted.

The light emission control driver 400 is connected to the plurality of light emission control lines EL1 to ELn, and may apply the light emission signal (referring to ELS of FIG. 2) made of the combination of the gate-on voltage and the gate-off voltage according to the light emission control signal CONT3 to the plurality of light emission control lines EL1 to ELn. The light emission signal ELS is applied to the plurality of pixels PX through the plurality of light emission control lines EL1 to ELn. The light emission control driver 400 may control a pulse width of the light emission signal ELS applied to the plurality of pixels PX according to the light emission control signal CONT3.

FIG. 2 is a view showing a pixel according to according to some exemplary embodiments. The pixel PX disposed on the n-th pixel row and the m-th pixel column among the plurality of pixels PX included in the display device of FIG. 1 is described as an example.

Referring to FIG. 2, the pixel PX includes the light emitting diode LED and a pixel circuit 20 controlling a current flowing to the light emitting diode LED from the first power source voltage ELVDD. The first gate line SLn, the second gate line SLIn, the third gate line SLBn, the data line DLm, and the light emission control line ELn may be connected to the pixel circuit 20. The second gate line SLIn may be a gate line to which the gate-on voltage is applied earlier than the first gate line SLn by, for instance, 1 horizontal period. The 1 horizontal period may correspond to one horizontal synchronizing signal Hsync. The third gate line SLBn may be a gate line to which the gate-on voltage is applied earlier than the second gate line SLIn by, for instance, 1 horizontal period, a gate line to which the gate-on voltage is simultaneously applied with the second gate line SLIn, or a gate line to which the gate-on voltage is simultaneously applied with the first gate line SLn.

The pixel circuit 20 may include a driving transistor TR11, a switching transistor TR12, a compensation transistor TR13, a first light emission control transistor TR14, a second light emission control transistor TR15, and initialization transistor TR16, a reset transistor TR17, and a storage capacitor Cst.

The driving transistor TR11 includes a gate electrode connected to a first node N11, a first electrode connected to a second node N12, and a second electrode connected to a third node N13. The driving transistor TR11 is connected between the first power source voltage ELVDD and the light emitting diode LED, and controls the current amount flowing to the light emitting diode LED from the first power source voltage ELVDD by corresponding to the voltage of the first node N11.

The switching transistor TR12 includes a gate electrode connected to the first gate line SLn, a first electrode connected to the data line DLm, and a second electrode connected to the second node N12. The switching transistor TR12 is connected between the data line DLm and the driving transistor TR11, and is turned on depending on the first gate signal of the gate-on voltage applied to the first gate line SLn to transmit the data voltage Vdat applied to the data line DLm to the second node N12.

The compensation transistor TR13 includes a gate electrode connected to the first gate line SLn, a first electrode connected to the third node N13, and a second electrode connected to the first node N11. The compensation transistor TR13 is connected between the second electrode and the gate electrode of the driving transistor TR11, and is turned on depending on the first gate signal of the gate-on voltage applied to the first gate line SLn. The compensation transistor TR13 may diode-connect the driving transistor TR11 to compensate a threshold voltage of the driving transistor TR11. The data voltage in which the threshold voltage of the driving transistor TR11 is compensated is transmitted to the first node N11.

The first light emission control transistor TR14 includes a gate electrode connected to the light emission control line ELn, a first electrode connected to the first power source voltage ELVDD, and a second electrode connected to the second node N12. The first light emission control transistor TR14 is connected between the first power source voltage ELVDD and the driving transistor TR11, and is turned on depending on the light emission signal ELS of the gate-on voltage applied to the light emission control line ELn to transmit the first power source voltage ELVDD to the driving transistor TR11.

The second light emission control transistor TR15 includes a gate electrode connected to the light emission control line ELn, a first electrode connected to the third node N13, and a second electrode connected to the anode of the first electrode and the light emitting diode LED. The second light emission control transistor TR15 is connected between the driving transistor TR11 and the light emitting diode LED, and is turned on depending on the light emission signal ELS of the gate-on voltage applied to the light emission control line ELn to transmit the current flowing through the driving transistor TR11 to the light emitting diode LED.

The initialization transistor TR16 includes a gate electrode connected to the second gate line SLIn, a first electrode connected to the initialization voltage Vint, and a second electrode connected to the first node N11. The initialization transistor TR16 is connected between the gate electrode of the driving transistor TR11 and the initialization voltage Vint, and is turned on by the second gate signal of the gate-on voltage applied to the second gate line SLIn. The initialization transistor TR16 may transmit the initialization voltage Vint to the first node N11 to initialize the gate voltage of the driving transistor TR11 to the initialization voltage Vint.

The reset transistor TR17 includes a gate electrode connected to the third gate line SLBn, a first electrode connected to the initialization voltage Vint, and a second electrode connected to the anode of the light emitting diode LED. The reset transistor TR17 is connected between the anode of the light emitting diode LED and the initialization voltage Vint, and is turned on by the third gate signal of the gate-on voltage applied to the third gate line SLBn. The reset transistor TR17 may transmit the initialization voltage Vint to the anode of the light emitting diode LED to reset the light emitting diode LED to the initialization voltage Vint. In some exemplary embodiments, the reset transistor TR17 may be omitted.

The driving transistor TR11, the switching transistor TR12, the compensation transistor TR13, the first light emission control transistor TR14, the second light emission control transistor TR15, the initialization transistor TR16, and the reset transistor TR17 may each be a p-channel electric field effect transistor. The gate-on voltage that turns on the p-channel electric field effect transistor is a low-level voltage and the gate-off voltage that turns off the p-channel electric field effect transistor is a high-level voltage.

According to some exemplary embodiments, at least one among the driving transistor TR11, the switching transistor TR12, the compensation transistor TR13, the first light emission control transistor TR14, the second light emission control transistor TR15, the initialization transistor TR16, and the reset transistor TR17 may be an n-channel electric field effect transistor. The gate-on voltage that turns on the n-channel electric field effect transistor is a high-level voltage and the gate-off voltage that turns off the n-channel electric field effect transistor is a low-level voltage.

The storage capacitor Cst includes a first electrode connected to the first power source voltage ELVDD and a second electrode connected to the first node N11. The data voltage in which the threshold voltage of the driving transistor TR11 is compensated is transmitted to the first node N11, and the storage capacitor Cst has a function of maintaining the voltage of the first node N11.

The light emitting diode LED includes the anode connected to the second electrode of the second light emission control transistor TR15 and the cathode connected to the second power source voltage ELVSS. The light emitting diode LED is connected between the pixel circuit 20 and the second power source voltage ELVSS, thereby emitting the luminance corresponding to the current supplied from the pixel circuit 20. The light emitting diode LED may include an emission layer including at least one of an organic emission material and an inorganic emission material. Holes and electrons are injected to the organic emission layer from the anode and the cathode, and emission of light from the organic emission layer is made in response to the excitons being combinations of the injected holes and electrodes dropping from an excited state to a ground state. The light emitting diode LED may emit one among primary colors or white. For example, the primary colors may be three primary colors of red, green, and blue. Another example of the primary colors may be yellow, cyan, magenta, etc.

FIG. 3 is a block diagram showing a signal controller according to some exemplary embodiments.

Referring to FIG. 3, the signal controller 100 includes a frame frequency detection unit 110, a data generation unit 120, and a look-up table (LUT) 130.

The frame frequency detection unit 110 may detect the frame frequency using the vertical synchronization signal Vsync and the horizontal synchronizing signal Hsync. The frame frequency detection unit 110 may detect the frame frequency by counting the horizontal synchronizing signal Hsync received until the next vertical synchronization signal Vsync is received after one vertical synchronization signal Vsync is received. The frame frequency detection unit 110 generates the frame frequency information FFI based on the detected frame frequency. The frame frequency information FFI may include information for a number of the frame images displayed per second. Also, the frame frequency information FFI may include the information for the expanded frame period (referring to EFL of FIG. 5). The expanded frame period EFL is a part exceeding the reference frame period (referring to RFL of FIG. 5) in one frame. The reference frame period RFL may correspond to a period in which the plurality of pixels PX may emit with a predetermined luminance by corresponding to the input data voltage Vdat. The frame frequency detection unit 110 transmits the frame frequency information FFI to the data generation unit 120.

The data generation unit 120 receives the image signal ImS, the vertical synchronization signal Vsync, the horizontal synchronizing signal Hsync, and the frame frequency information FFI, and generates the image data signal DAT based thereon. The data generation unit 120 may divide the image signal ImS by the frame unit according to the vertical synchronization signal Vsync and divide the image signal ImS by the unit of the gate lines SL1 to SLn according to the horizontal synchronizing signal Hsync to generate the image data signal DAT. The data generation unit 120 may know the predetermined reference frame period RFL and correct the image data signal DAT by confirming the expanded frame period EFL from the frame frequency information FFI. The data generation unit 120 may correct the image data signal DAT by increasing or decreasing the gray level of the image data signal DAT by corresponding to the expanded frame period EFL. A method of correcting the image data signal DAT will be described later in association with FIGS. 5 to 8.

The look-up table 130 may store the information for correcting the image data signal DAT corresponding to the expanded frame period EFL. The data generation unit 120 may correct the image data signal DAT corresponding to the expanded frame period EFL by reading the information for the corrected image data signal from the look-up table 130. According to some exemplary embodiments, the look-up table 130 may be omitted and the data generation unit 120 may arithmetically correct the image data signal DAT.

FIG. 4 is the block diagram showing a signal controller according to some another exemplary embodiments.

Referring to FIG. 4, the signal controller 100_1 includes the frame frequency detection unit 110, the data generation unit 120, the look-up table 130, and a clock signal generation unit 140. That is, compared with FIG. 3, the signal controller 100_1 further includes the clock signal generation unit 140.

The clock signal generation unit 140 generates a clock signal CLK that is repeated in an on voltage and an off voltage manner with a predetermined period. The clock signal generation unit 140 provides the clock signal CLK to the frame frequency detection unit 110.

The frame frequency detection unit 110 may detect the frame frequency using the vertical synchronization signal Vsync and the clock signal CLK. The frame frequency detection unit 110 may detect the frame frequency by counting the clock signal CLK received until the next vertical synchronization signal Vsync is received after one vertical synchronization signal Vsync is received.

Except for above-noted differences, the signal controller 100 described with reference to FIG. 3 may all be applied to the signal controller 100_1 described with reference to FIG. 4 such that the repeated description between the exemplary embodiments is omitted.

Next, an exemplary embodiment of a method in which the data generation unit 120 corrects the image data signal DAT by corresponding to the varied frame frequency is described with reference to FIGS. 5 to 8.

Figure 5:
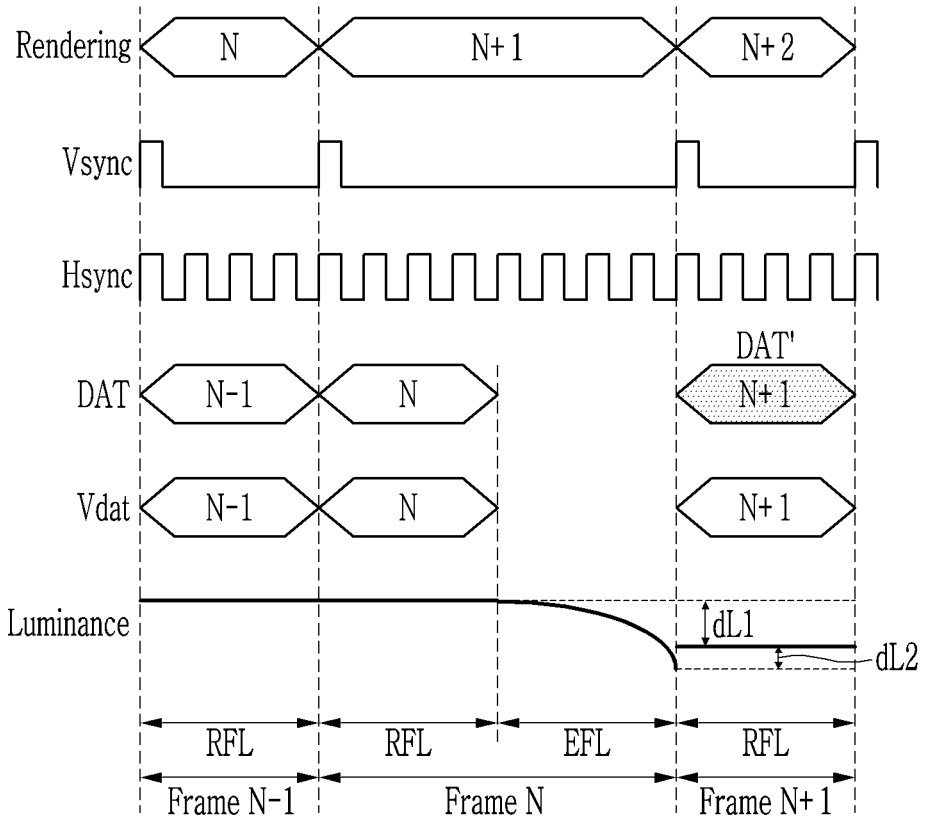
FIGS. 5 to 8 are timing diagrams showing a method of driving a display device according to some exemplary embodiments.
Figure 6:
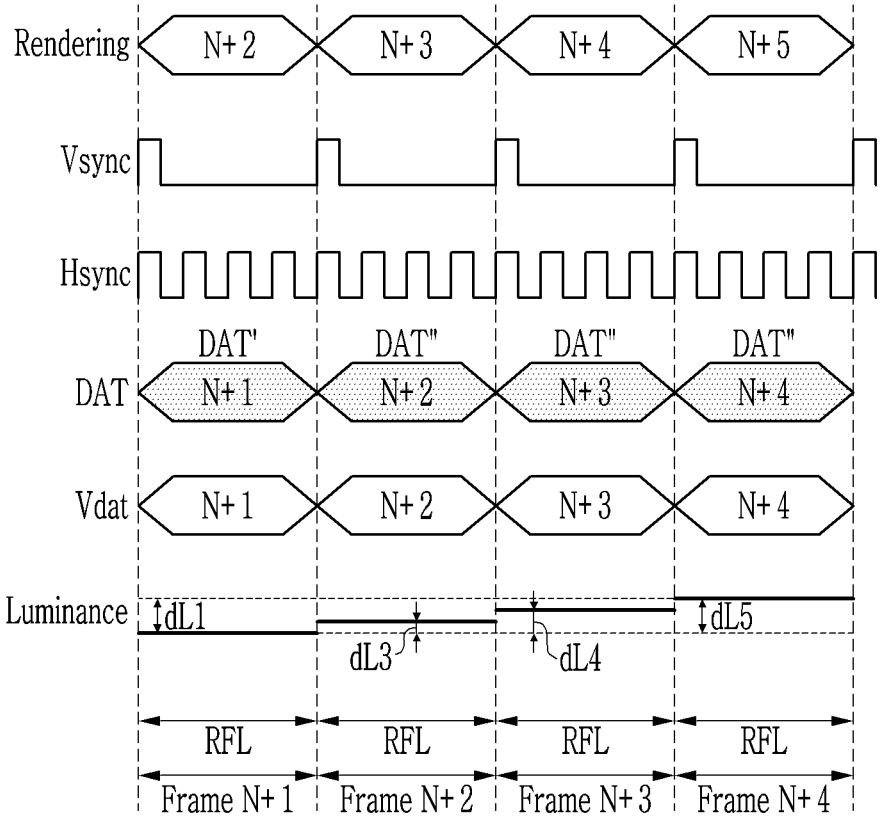
Figure 7:
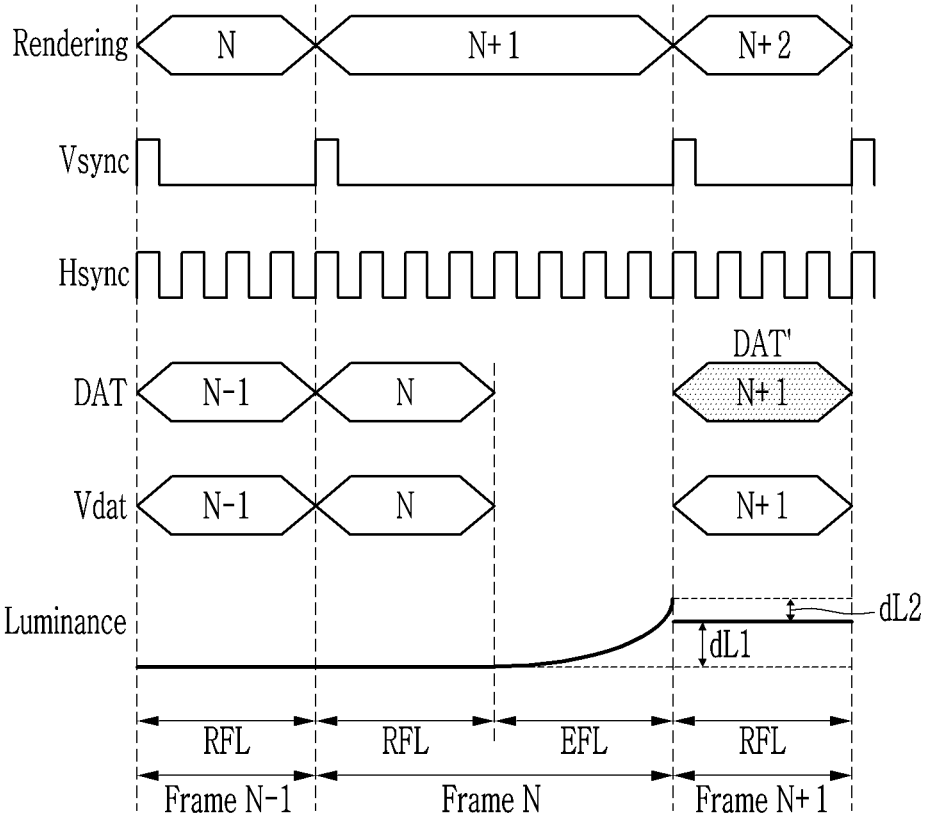
Figure 8:
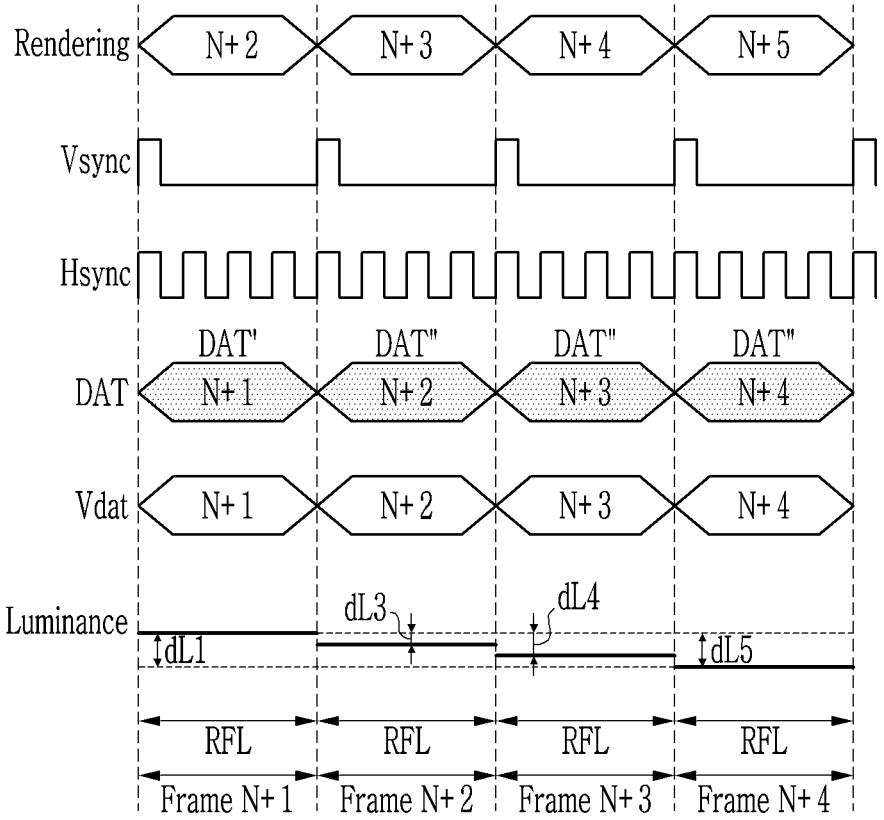

FIGS. 5 to 8 are timing diagrams showing a method of driving a display device according to some exemplary embodiments. FIGS. 5 and 6 show a method of driving the display device of FIG. 1 for a case that the image signal ImS includes a gray level of a high gray, and FIGS. 7 and 8 show a method of driving the display device of FIG. 1 for a case that the image signal ImS includes a gray level of a low gray.

The raw data is processed by a method, such as rendering, in the graphics processing unit 800, and in this case, the time taken to generate the image signal ImS by processing the raw data corresponding to one frame may be varied.

As shown in FIG. 5, the time for processing the raw data corresponding to the (N+1)-th frame may be double compared with the time for processing the raw data corresponding to the N-th frame. The time for processing the raw data corresponding to the (N+2)-th frame may be the same as the time for processing the raw data corresponding to the N-th frame.

The graphics processing unit 800 transmits the image signal ImS corresponding thereto after completing the raw data process corresponding to the N-th frame along with the vertical synchronization signal Vsync to the signal controller 100. The graphics processing unit 800 transmits the image signal ImS corresponding thereto after completing the raw data process corresponding to the (N+1)-th frame along with the vertical synchronization signal Vsync to the signal controller 100. The graphics processing unit 800 transmits the image signal ImS corresponding thereto after completing the raw data process corresponding to the (N+2)-th frame along with the vertical synchronization signal Vsync to the signal controller 100. The graphics processing unit 800 may continuously transmit the horizontal synchronizing signal Hsync in which the on voltage and the off voltage of the predetermined period are repeated to the signal controller 100.

The time that the raw data corresponding to the N-th frame is processed may correspond to the period in which the image of the (N−1)-th frame is displayed in the display unit 600, that is, the (N−1)-th frame. The time in which the raw data corresponding to the (N+1)-th frame is processed may correspond to the period in which the image of the N-th frame is displayed in the display unit 600, that is, the N-th frame. The time in which the raw data corresponding to the (N+2)-th frame is processed may correspond to the period in which the image of the (N+1)-th frame is displayed in the display unit 600, that is, the (N+1)-th frame.

Next, an example in which the period of the (N−1)-th frame and the period of the (N+1)-th frame are the same as the reference frame period RFL is described. The reference frame period RFL may include a period in which the data voltage Vdat is input to the plurality of pixels PX and a period in which the plurality of pixels PX emit with the luminance corresponding to the data voltage Vdat. The reference frame period RFL may be previously determined as a period in which the plurality of pixels PX may emit with a predetermined luminance by corresponding to the input data voltage Vdat.

Also, an example in which the image signal ImS input to the signal controller 100 during the plurality of frames includes the gray level of the high gray is described in FIGS. 5 and 6. The high gray may be a higher gray than a predetermined gray (e.g., a middle gray).

In the (N−1)-th frame, the signal controller 100 generates the image data signal DAT to be transmitted to the data driver 300. The data driver 300 outputs the data voltage Vdat corresponding to the image data signal DAT. The plurality of pixels PX emit the luminance corresponding to the data voltage Vdat. That is, during the reference frame period RFL, the generation of the image data signal DAT, the output of the data voltage Vdat, and the emission of light via the plurality of pixels PX may be performed.

As the time in which the raw data corresponding to the (N+1)-th frame is processed is longer than the time in which the raw data corresponding to the N-th frame is processed, the period of the N-th frame is longer than the period of the (N−1)-th frame. As such, the N-th frame may include the reference frame period RFL and the expanded frame period EFL.

During the reference frame period RFL of the N-th frame, the signal controller 100 generates the image data signal DAT according to the image signal ImS corresponding to the N-th frame to be transmitted to the data driver 300, and the data driver 300 outputs the data voltage Vdat corresponding to the image data signal DAT, and the plurality of pixels PX emit with the luminance corresponding to the data voltage Vdat.

A light emission state of the plurality of pixels PX is maintained during the expanded frame period EFL of the N-th frame. That is, during the expanded frame period EFL, the generation of the image data signal DAT or the output of the data voltage Vdat are not performed and only the emission of the plurality of pixels PX may be performed.

For example, the gate voltage of the driving transistor TR11 is maintained by the storage capacitor Cst shown in FIG. 2 such that the pixel PX may maintain the light emission state. When the data voltage Vdat of the low level is maintained as the gate voltage of the driving transistor TR11 by corresponding to the image signal ImS of the high gray, the gate voltage of the driving transistor TR11 may be increased by a leakage current of the compensation transistor TR13 or other transistors as time passes. Accordingly, an amount of the current flowing to the light emitting diode LED decreases such that the luminance of the pixel PX may be gradually decreased.

Due to these causes, if the expanded frame period EFL extends after passing the reference frame period RFL in the N-th frame, the luminance of the high gray of the plurality of pixels PX may be gradually decreased.

In the (N+1)-th frame, when the signal controller 100 generates the image data signal DAT so that the plurality of pixels PX emit with the same luminance as the luminance in the reference frame period RFL of the (N−1)-th frame or the N-th frame according to the image signal ImS, the difference of the luminance that is finally decreased in the expanded frame period EFL of the N-th frame and the luminance in the (N+1)-th frame may be largely generated. Accordingly, the flicker may be generated between the N-th frame and the (N+1)-th frame.

However, the signal controller 100 may detect the frame frequency using the vertical synchronization signal Vsync and the horizontal synchronizing signal Hsync like the exemplary embodiment of FIG. 3 or using the vertical synchronization signal Vsync and the clock signal CLK like the exemplary embodiment of FIG. 4, and the frame frequency may be varied by half in the N-th frame. The data generation unit 120 may generate the corrected image data signal DAT' of which the image data signal DAT is corrected by lowering the gray level so that the image data signal DAT is lowered by a first luminance difference dL1 corresponding to the expanded frame period EFL of the N-th frame in the (N+1)-th frame next to the frame (i.e., the N-th frame) in which the variation of the frame frequency is detected. In this case, the luminance of the corrected image data signal DAT' may be higher than the luminance that is finally reduced in the expanded frame period EFL of the N-th frame by a second luminance difference dL2. The second luminance difference dL2 may be a degree of the luminance difference at which the flicker is not recognized between the N-th frame and the (N+1)-th frame.

The signal controller 100 may calculate the corrected image data signal DAT' according to Equation 1:

$$DAT'=DAT-DAT\times A(EFL/RFL) \quad \text{Equation 1}$$

Here, DAT' is the corrected image data signal, DAT is the image data signal before the correction, EFL is the expanded frame period, RFL is the reference frame period, and A is a proportional constant. The proportional constant A may be determined by considering a degree at which the luminance of the pixel PX is decreased in the expanded frame period EFL, a spec limiting the luminance difference between the frames according to the variation of the frame frequency, etc.

That is, the corrected image data signal DAT' may be generated using Equation 1 such that the luminance is lowered by the first luminance difference dL1 almost proportionally to the expanded frame period EFL in the image data signal DAT before the correction.

The first luminance difference dL1 may be determined by satisfying the spec limiting the luminance difference between the frames according to the variation of the frame frequency. For example, if it is assumed that the luminance in the maximum frame frequency and the luminance in the half frame frequency of the maximum frame frequency are limited by 4% or less in the spec, the corrected image data signal DAT' may be generated such that the first luminance difference dL1 becomes 4% or less.

In the (N+1)-th frame, the signal controller 100 outputs the corrected image data signal DAT', the data driver 300 outputs the data voltage Vdat according to the corrected image data signal DAT', and the plurality of pixels PX may be emitted with the luminance that is lower than the luminance of the reference frame period RFL of the N-th frame by the first luminance difference dL1 and is higher than the luminance that is finally decreased in the expanded frame period EFL of the N-th frame by the second luminance difference dL2. Accordingly, the flicker may not be recognized between the N-th frame and the (N+1)-th frame.

The (N+1)-th frame includes the reference frame period RFL. The signal controller 100 may confirm that the frame frequency is originally varied (e.g., increased by two times) by detecting the frame frequency in the (N+1)-th frame. The signal controller 100 corrects the image data signal DAT into the recovering image data signal DAT" from the (N+2)-th frame as the frame next to the frame (i.e., the (N+1)-th frame) in which the variation of the frame frequency is detected (e.g., increased by two times). The correction to the recovering image data signal DAT" is described with reference to FIG. 6.

Referring to FIG. 6 the (N+1)-th frame, the (N+2)-th frame, the (N+3)-th frame, and the (N+4)-th frame are shown continuously from FIG. 5 in FIG. 6. The (N+1)-th to the (N+4)-th frames include the reference frame period RFL.

The signal controller 100 may generate the recovering image data signal DAT" by correcting the image data signal DAT so as to be displayed with the higher luminance than the luminance of the corrected image data signal DAT' through at least one frame following the (N+1)-th frame.

As shown in FIG. 6, an example in which the recovering image data signal DAT" is output through the (N+2)-th frame, the (N+3)-th frame, and the (N+4)-th frame is described. In the (N+2)-th frame, the signal controller 100 may generate the recovering image data signal DAT" so that the luminance of the image is higher than the luminance of the corrected image data signal DAT' by a third luminance difference dL3. In the (N+3)-th frame, the signal controller 100 may generate the recovering image data signal DAT" so that the luminance of the image is higher than the luminance of the corrected image data signal DAT' by a fourth luminance difference dL4. In the (N+4)-th frame, the signal controller 100 may generate the recovering image data signal DAT" so that the luminance of the image is higher than the luminance of the corrected image data signal DAT' by a fifth luminance difference dL5. The fourth luminance difference dL4 may be larger than the third luminance difference dL3, the fifth luminance difference dL5 may be larger than the fourth luminance difference dL4, and the fifth luminance difference dL5 may be the same as the first luminance difference dL1. The third luminance difference dL3, the fourth luminance difference dL4, and the fifth luminance difference dL5 may satisfy the spec limiting the luminance difference between the frames according to the variation of the frame frequency.

That is, the recovering image data signal DAT" may be generated so that the luminance of the image is increased step-by-step from the luminance of the corrected image data signal DAT' through the (N+2)-th frame, the (N+3)-th frame, and the (N+4)-th frame to be the same as the luminance of the image data signal DAT before the correction.

The signal controller 100 may calculate the recovering image data signal DAT" according to Equation 2.

$$DAT''=DAT'+ABS[DAT-DAT']\times(CF/RF) \quad \text{Equation 2}$$

Here, DAT" is the recovering image data signal, DAT' is the corrected image data signal, DAT is the image data signal before the correction, CF is an order of the frames generating the recovering image data signal DAT", and RF is a number of the frames generating the recovering image data signal DAT". The RF may be previously determined as a constant value.

For example, when the RF is determined as 3, as shown in FIG. 6, the recovering image data signal DAT" may be generated through three frames from the (N+2)-th frame to the (N+4)-th frame. In the (N+2)-th frame, the CF becomes 1, and the recovering image data signal DAT" may be generated so that the luminance is increased by one third of the difference of the image data signal DAT before the correction and the corrected image data signal DAT'. In the (N+3)-th frame, the CF becomes 2, and the recovering image data signal DAT" may be generated so that the luminance is increased by two thirds of the difference of the image data signal DAT before the correction and the corrected image data signal DAT'. In the (N+4)-th frame, the CF becomes 3, and the recovering image data signal DAT" may be generated so that the luminance is increased by the difference of the image data signal DAT before the correction and the corrected image data signal DAT'. In the (N+4)-th frame, the luminance of the recovering image data signal DAT" becomes the same as the luminance of the image data signal DAT before the correction.

Next, a method of driving the display device of FIG. 1 for a case that the image signal ImS includes the gray level of the low gray is described with reference to FIGS. 7 and 8. Differences are mainly described as compared with FIGS. 5 and 6 described above. In FIGS. 7 and 8, an example in which the image signal ImS input to the signal controller 100 during the plurality of frames includes the gray level of the constant low gray is described. The low gray may be the lower gray than a predetermined gray (e.g., the middle gray).

Referring to FIG. 7, the light emission state of the plurality of pixels PX is maintained during the expanded frame period EFL of the N-th frame. For example, by the storage capacitor Cst shown in FIG. 2, the data voltage Vdat of the high level corresponding to the image signal ImS of the low gray may be maintained as the gate voltage of the driving transistor TR11. In this case, the gate voltage of the driving transistor TR11 may be decreased by the leakage current of the initialization transistor TR16 or the other transistors as time passes. Accordingly, the amount of the current flowing to the light emitting diode LED is increased such that the luminance of the pixel PX may be gradually increased.

Due to these causes, if the expanded frame period EFL extends after passing the reference frame period RFL in the N-th frame, the luminance of the high gray of the plurality of pixels PX may be gradually increased.

In the (N+1)-th frame, when the signal controller 100 generates the image data signal DAT so that the plurality of pixels PX emit light with the same luminance as the luminance in the reference frame period RFL of the (N−1)-th frame or the N-th frame according to the image signal ImS, the difference of the luminance that is finally increased in the expanded frame period EFL of the N-th frame and the luminance in the (N+1)-th frame may be largely generated. Thus, the flicker may be generated between the N-th frame and the (N+1)-th frame.

The data generation unit 120 may generate the corrected image data signal DAT' of which the image data signal DAT is corrected by increasing the gray level so that the image data signal DAT is increased by the first luminance difference dL1 corresponding to the expanded frame period EFL of the N-th frame in the (N+1)-th frame next to the frame (i.e., the N-th frame) in which the variation of the frame frequency is detected. In this case, the luminance of the corrected image data signal DAT' may be higher than the luminance that is finally increased in the expanded frame period EFL of the N-th frame by the second luminance difference dL2. The second luminance difference dL2 may be the degree of the luminance difference at which the flicker is not recognized between the N-th frame and the (N+1)-th frame.

The signal controller 100 may calculate the corrected image data signal DAT' according to Equation 3.

$$DAT'=DAT+DAT\times A(EFL/RFL) \quad \text{Equation 3}$$

That is, the corrected image data signal DAT' may be generated using Equation 3 so that the luminance is increased by the first luminance difference dL1 almost proportionally to the expanded frame period EFL in the image data signal DAT before the correction.

In the (N+1)-th frame, the signal controller 100 outputs the corrected image data signal DAT', the data driver 300 outputs the data voltage Vdat according to the corrected image data signal DAT', and the plurality of pixels PX may emit light with the luminance that is higher than the luminance of the reference frame period RFL of the N-th frame by the first luminance difference dL1 and is lower than the luminance that is finally decreased in the expanded frame period EFL of the N-th frame by the second luminance difference dL2. Accordingly, the flicker may not be recognized between the N-th frame and the (N+1)-th frame.

Next, a method of correcting the image data signal DAT into the recovering image data signal DAT" from the (N+2)-th frame is described with reference to FIG. 8.

Referring to FIG. 8, the (N+1)-th frame, the (N+2)-th frame, the (N+3)-th frame, and the (N+4)-th frame are shown continuously from FIG. 7 in FIG. 8. The (N+1)-th frame to the (N+4)-th frame include the reference frame period RFL.

The signal controller 100 may generate the recovering image data signal DAT" by correcting the image data signal DAT so as to be displayed with the lower luminance than the luminance of the corrected image data signal DAT' through at least one frame following the (N+1)-th frame.

As shown in FIG. 8, the recovering image data signal DAT" may be output through the (N+2)-th frame, the (N+3)-th frame, and the (N+4)-th frame. In the (N+2)-th frame, the signal controller 100 may generate the recovering image data signal DAT" so that the luminance of the image is lower than the luminance of the corrected image data signal DAT' by the third luminance difference dL3. In the (N+3)-th frame, the signal controller 100 may generate the recovering image data signal DAT" so that the luminance of the image is lower than the luminance of the corrected image data signal DAT' by the fourth luminance difference dL4. In the (N+4)-th frame, the signal controller 100 may generate the recovering image data signal DAT" so that the luminance of the image is lower than the luminance of the corrected image data signal DAT' by the fifth luminance difference dL5.

That is, the recovering image data signal DAT" may be generated so that the luminance of the image is decreased step-by-step from the luminance of the corrected image data signal DAT' through the (N+2)-th frame, the (N+3)-th frame, and the (N+4)-th frame to be the same as the luminance of the image data signal DAT before the correction.

The signal controller 100 may calculate the recovering image data signal DAT" according to Equation 4.

$$DAT''=DAT'-ABS[DAT-DAT']\times(CF/RF) \quad \text{Equation 4}$$

For example, when the RF is determined as 3, as shown in FIG. 8, the recovering image data signal DAT" may be generated through three frames from the (N+2)-th frame to the (N+4)-th frame. In the (N+2)-th frame, the CF becomes 1, and the recovering image data signal DAT" may be generated so that the luminance is decreased by one third of the difference of the image data signal DAT before the correction and the corrected image data signal DAT'. In the (N+3)-th frame, the CF becomes 2, and the recovering image data signal DAT" may be generated so that the luminance is decreased by two thirds of the difference of the image data signal DAT before the correction and the corrected image data signal DAT'. In the (N+4)-th frame, the CF becomes 3, and the recovering image data signal DAT" may be generated so that the luminance is decreased by the difference of the image data signal DAT before the correction and the corrected image data signal DAT'. In the (N+4)-th frame, the luminance of the recovering image data signal DAT" becomes the same as the luminance of the image data signal DAT before the correction.

In FIGS. 5 to 8, as described above, in the cases that the image signal ImS includes the gray level of the high gray and the gray level of the low gray, the signal controller 100 may include the corrected image data signal DAT' and the recovering image data signal DAT" as the frame frequency is varied.

The information for the corrected image data signal DAT' and the recovering image data signal DAT" may be stored to the look-up table 130 described above in FIGS. 3 and 4, and the data generation unit 120 may read the information for the corrected image data signal DAT' and the recovering image data signal DAT" from the look-up table 130 and correct the image data signal DAT.

A method of adjusting the luminance of the frame for preventing the flicker between the frames by generating the corrected image data signal DAT' and the recovering image data signal DAT" may be referred to as a data dimming method.

Next, a signal controller according to other exemplary embodiments will be described with reference to FIG. 9, and a method of driving the display device according to the other exemplary embodiments will be described with reference to FIGS. 10 to 13. Differences are mainly described as compared with FIGS. 3 to 8 described above.

Figure 9:
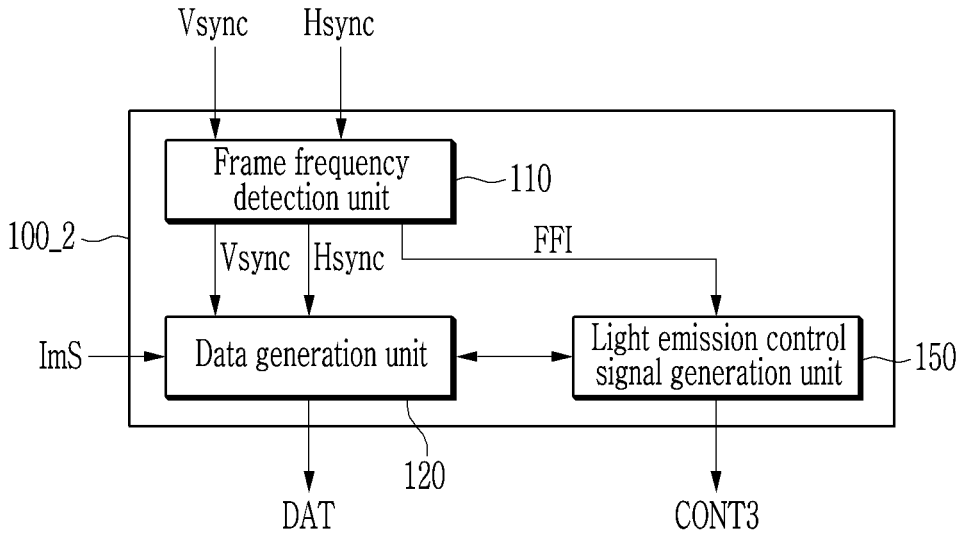
FIG. 9 is a block diagram showing a signal controller according to some exemplary embodiments.

FIG. 9 is a block diagram showing a signal controller according to some exemplary embodiments.

Referring to FIG. 9, the signal controller 100_2 includes the frame frequency detection unit 110, the data generation unit 120, and a light emission control signal generation unit 150.

The frame frequency detection unit 110 detects the frame frequency using the vertical synchronization signal Vsync and the horizontal synchronizing signal Hsync, and transmits the frame frequency information FFI to the light emission control signal generation unit 150. Although not shown in FIG. 9, as shown in FIG. 4, the signal controller 100_2 may further include the clock signal generation unit 140, and the frame frequency detection unit 110 may detect the frame frequency using the vertical synchronization signal Vsync and the clock signal CLK.

The data generation unit 120 generates the image data signal DAT based on the image signal ImS, the vertical synchronization signal Vsync, and the horizontal synchronizing signal Hsync.

The light emission control signal generation unit 150 generates the light emission control signal CONT3 based on the frame frequency information FFI. The light emission period in which the light emission signal ELS output from the light emission control driver 400 is applied as the gate-on voltage may be adjusted by the light emission control signal CONT3. The light emission control signal generation unit 150 may adjust the luminance of the image by increasing or decreasing the light emission period corresponding to the expanded frame period EFL depending on the variation of the frame frequency. That is, the light emission control signal generation unit 150 may adjust the luminance of the image by controlling the pulse width of the light emission signal ELS corresponding to the luminance that is changed according to the expanded frame period EFL, thereby preventing the flicker from being recognized between the frames. The light emission control signal generation unit 150 receives a signal of whether the image signal ImS includes the gray level of the high gray or the gray level of the low gray from the data generation unit 120.

Next, some exemplary embodiments of a method for adjusting the light emission period by the signal controller 100_2 corresponding to the varied frame frequency is described with reference to FIGS. 10 to 13.

Figure 10:
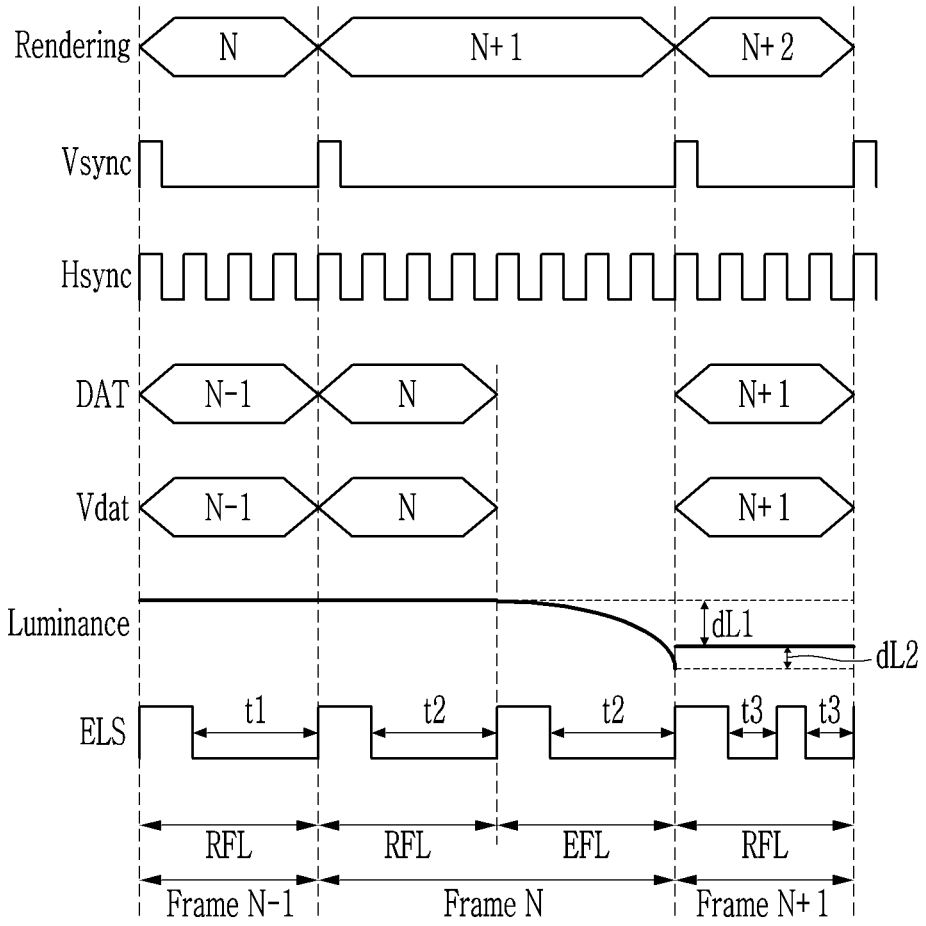
FIGS. 10 to 13 are timing diagrams showing a method of driving a display device according to some exemplary embodiments.
Figure 11:
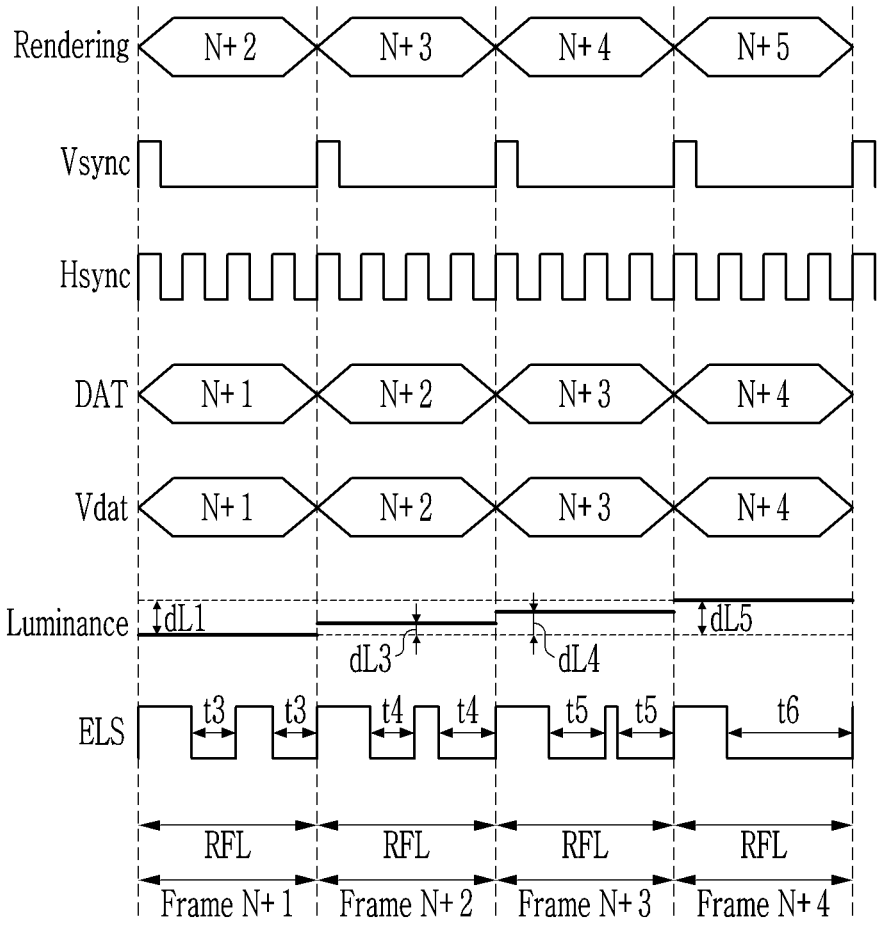
Figure 12:
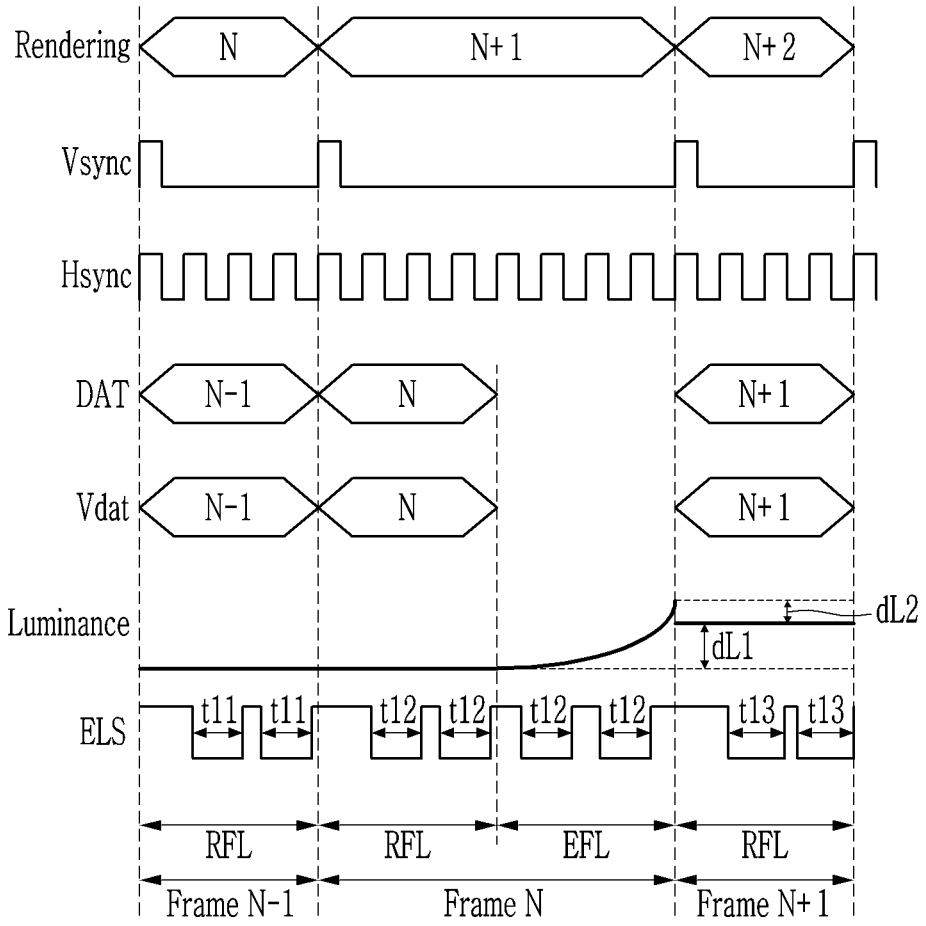
Figure 13:
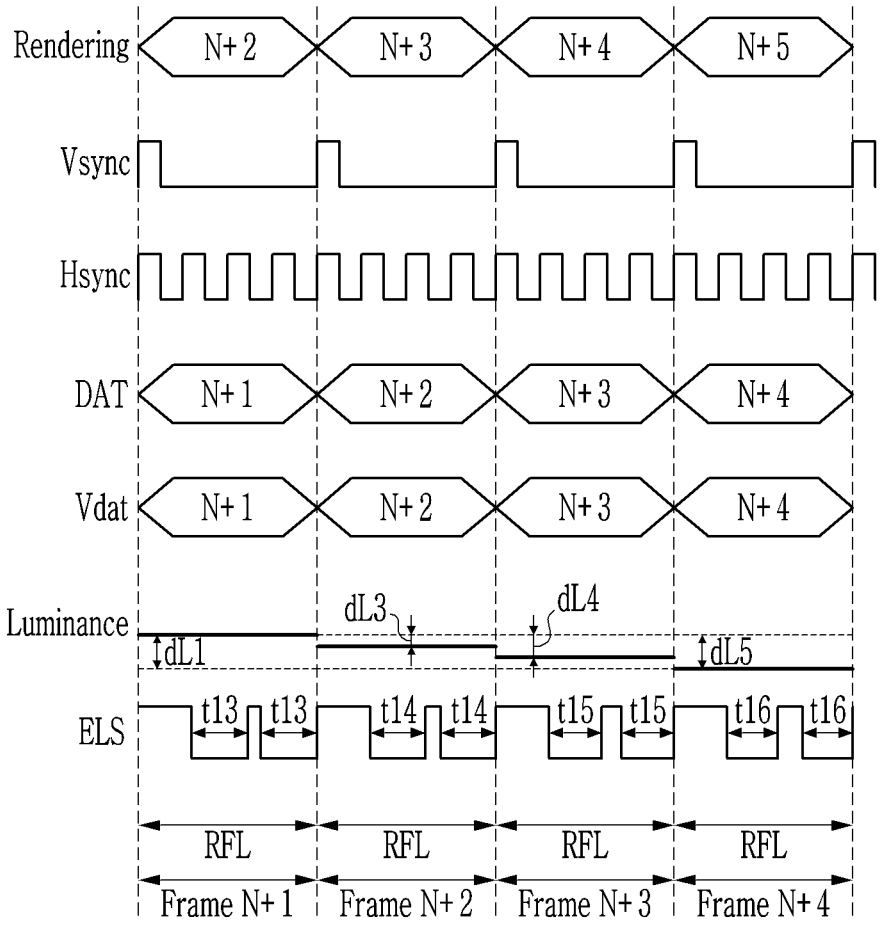

FIGS. 10 to 13 are timing diagrams showing a method of driving a display device according to some exemplary embodiments. FIGS. 10 and 11 show the method of driving the display device in a case that the image signal ImS includes the gray level of the high gray, and FIGS. 12 and 13 show the method of driving the display device in a case that the image signal ImS includes the gray level of the low gray.

Referring to FIG. 10, as compared with FIG. 5, in the (N+1)-th frame, the image data signal DAT is output without the correction, and the light emission period t3 of which the light emission signal ELS is applied as the gate-on voltage is adjusted according to the light emission control signal CONT3. The gate-on voltage of the light emission signal ELS is the low level voltage. That is, when the image signal ImS includes the gray level of the high gray, the light emission control signal generation unit 150 generates the light emission control signal CONT3 so that the light emission period t3 of the (N+1)-th frame is shorter than the light emission period t2 in the reference frame period RFL of the N-th frame.

In the (N+1)-th frame, as the light emission period t3 in which the plurality of pixels PX emit light is reduced, the luminance of the (N+1)-th frame may be lower than the luminance in the reference frame period RFL of the N-th frame by the first luminance difference dL1. In this case, the luminance of the (N+1)-th frame may be higher than the luminance that is finally decreased in the expanded frame period EFL of the N-th frame by the second luminance difference dL2. Accordingly, the flicker may not be recognized between the N-th frame and the (N+1)-th frame.

Referring to FIG. 11, as compared with FIG. 6, the image data signal DAT is output without the correction in the (N+1)-th frame to (N+4)-th frame, and the light emission periods t3, t4, t5, and t6 in which the light emission signal ELS is applied as the gate-on voltage are adjusted according to the light emission control signal CONT3. The light emission period t4 of the (N+2)-th frame is longer than the light emission period t3 of the (N+1)-th frame, the light emission period t5 of the (N+3)-th frame is longer than the light emission period t4 of the (N+2)-th frame, and the light emission period t6 of the (N+4)-th frame is longer than the light emission period t5 of the (N+3)-th frame.

As the light emission period t4 of the (N+2)-th frame is longer than the light emission period t3 of the (N+1)-th frame, the luminance of the (N+2)-th frame may be higher than the luminance of the (N+1)-th frame by the third luminance difference dL3. Also, as the light emission period t5 of the (N+3)-th frame is longer than the light emission period t4 of the (N+2)-th frame, the luminance of the (N+3)-th frame may be higher than the luminance of the (N+1)-th frame by the fourth luminance difference dL4. Also, as the light emission period t6 of the (N+4)-th frame is longer than the light emission period t5 of the (N+3)-th frame, the luminance of the (N+4)-th frame may be higher than the luminance of the (N+1)-th frame by the fifth luminance difference dL5. The light emission period t6 of the (N+4)-th frame may be the same as the light emission period t1 of the (N−1)-th frame or the light emission period t2 of the reference frame period RFL of the N-th frame. The luminance of the (N+4)-th frame may be the same as the luminance of the (N−1)-th frame or the luminance of the reference frame period RFL of the N-th frame. That is, as the luminance of the image is increased step-by-step through the (N+2)-th frame, the (N+3)-th frame, and the (N+4)-th frame, the luminance may be returned to the luminance of the image before the light emission period is adjusted.

That is, the light emission control signal generation unit 150 may control the pulse width of the light emission signal ELS by the light emission control signal CONT3 so that the luminance of the image is increased step-by-step through the at least one frame following the frame (e.g., the (N+1)-th frame) in which the luminance of the image is adjusted by reducing the light emission period.

Referring to FIG. 12, as compared with FIG. 7, the image data signal DAT is output without the correction in the (N+1)-th frame, and the light emission period t13 in which the light emission signal ELS is applied as the gate-on voltage is adjusted according to the light emission control signal CONT3. That is, when the image signal ImS includes the gray level of the low gray, the light emission control signal generation unit 150 generates the light emission control signal CONT3 so that the emission period t13 of the (N+1)-th frame is longer than the light emission period t12 in the reference frame period RFL of the N-th frame.

In the (N+1)-th frame, as the light emission period t13 in which the plurality of pixels PX emit light is elongated, the luminance of the (N+1)-th frame may be higher than the luminance in the reference frame period RFL of the N-th frame by the first luminance difference dL1. In this case, the luminance of the (N+1)-th frame may be lower than the luminance that is finally increased in the expanded frame period EFL of the N-th frame by the second luminance difference dL2. Accordingly, the flicker may not be recognized between the N-th frame and the (N+1)-th frame.

Referring to FIG. 13, as compared with FIG. 8, the image data signal DAT is output without the correction in the (N+1)-th frame to (N+4)-th frame, and the light emission periods t13, t14, t15, and t16 in which the light emission signal ELS is applied as the gate-on voltage are adjusted according to the light emission control signal CONT3. The light emission period t14 of the (N+2)-th frame is shorter than the light emission period t13 of the (N+1)-th frame, the light emission period t15 of the (N+3)-th frame is shorter than the light emission period t14 of the (N+2)-th frame, and the light emission period t16 of the (N+4)-th frame is shorter than the light emission period t15 of the (N+3)-th frame.

As the light emission period t14 of the (N+2)-th frame is shorter than the light emission period t13 of the (N+1)-th frame, the luminance of the (N+2)-th frame may be lower than the luminance of the (N+1)-th frame by the third luminance difference dL3. Also, as the light emission period t15 of the (N+3)-th frame is shorter than the light emission period t14 of the (N+2)-th frame, the luminance of the (N+3)-th frame may be lower than the luminance of the (N+1)-th frame by the fourth luminance difference dL4. Also, as the light emission period t16 of the (N+4)-th frame is shorter than the light emission period t15 pf the (N+3)-th frame, the luminance of the (N+4)-th frame may be lower than the luminance of the (N+1)-th frame by the fifth luminance difference dL5. The light emission period t16 of the (N+4)-th frame may be the same as the light emission period t11 of the (N−1)-th frame or the light emission period t12 of the reference frame period of the N-th frame. The luminance of the (N+4)-th frame may be the same as the luminance of the (N−1)-th frame or the luminance of the reference frame period of the N-th frame. That is, as the luminance of the image is decreased step-by-step through the (N+2)-th frame, the (N+3)-th frame, and the (N+4)-th frame, the luminance may be returned to the luminance of the image before the light emission period is adjusted.

That is, the light emission control signal generation unit 150 may control the pulse width of the light emission signal ELS by the light emission control signal CONT3 so that the luminance of the image is decreased step-by-step through at least one frame following the frame (e.g., the (N+1)-th frame) in which the luminance of the image is adjusted by elongating the light emission period.

A method of adjusting the luminance of the frame for preventing the flicker between the frames by adjusting the light emission period of the frame may be referred to as a pulse width modulation (PWM) dimming method.

Except for the above-noted differences, the characteristics of the various exemplary embodiments described with reference to FIGS. 3 to 8 may all be applied to the various exemplary embodiments described with reference to FIGS. 9 to 13 such that overlapping descriptions between the exemplary embodiments are omitted.

Next, a signal controller according to other exemplary embodiments is described with reference to FIG. 14.

Figure 14:
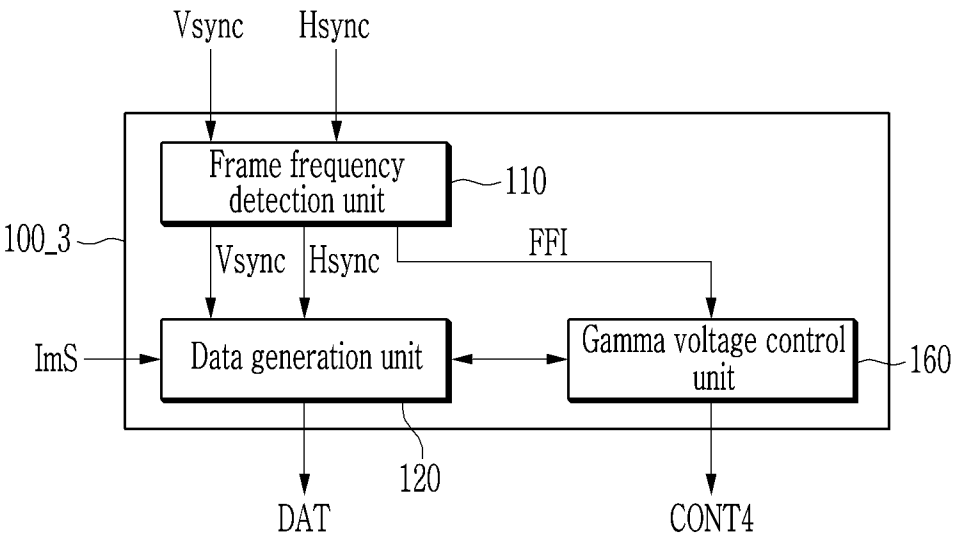
FIG. 14 is a block diagram showing a signal controller according to some exemplary embodiments.

FIG. 14 is a block diagram showing a signal controller according to some exemplary embodiments.

Referring to FIG. 14, the signal controller 100_3 includes the frame frequency detection unit 110, the data generation unit 120, and a gamma voltage control unit (or gamma voltage controller) 160.

The frame frequency detection unit 110 detects the frame frequency using the vertical synchronization signal Vsync and the horizontal synchronizing signal Hsync, and transmits the frame frequency information FFI to the gamma voltage control unit 160.

The data generation unit 120 generates the image data signal DAT based on the image signal ImS, the vertical synchronization signal Vsync, and the horizontal synchronizing signal Hsync.

The gamma voltage control unit 160 generates a gamma voltage control signal CONT4 based on the frame frequency information FFI. That is, the gamma voltage control unit 160 may confirm the expanded frame period EFL exceeding the reference frame period RFL in one frame from the frame frequency information FFI, and generate the gamma voltage control signal CONT4 corresponding to the luminance that is changed according to the expanded frame period EFL. The gamma voltage generator 350 may adjust the level of the reference gamma voltage according to the gamma voltage control signal CONT4. Because the data driver 300 generates the data voltage Vdat based on the reference gamma voltage, the data voltage Vdat may be adjusted according to the adjustment of the level of the reference gamma voltage.

The gamma voltage control unit 160 may display the image of the luminance that is increased or decreased by the first luminance difference dL1 by adjusting the reference gamma voltage in the frame following the frame in which the variation of the frame frequency is detected based on the frame frequency information FFI. Also, the gamma voltage control unit 160 may increase the luminance of the image that is decreased or the luminance of the image that is increased through the plurality of frames step-by-step by adjusting the reference gamma voltage based on the frame frequency information FFI. The luminance of the image adjusted by the gamma voltage control unit 160 in the varied frame may refer the luminance change described in FIGS. 5 to 8, or the change of the luminance described in FIGS. 10 to 13.

Next, a signal controller according to other exemplary embodiments is described with reference to FIG. 15, and a method of driving the display device according to the other exemplary embodiments will be described with reference to FIGS. 16 and 17.

Figure 15:
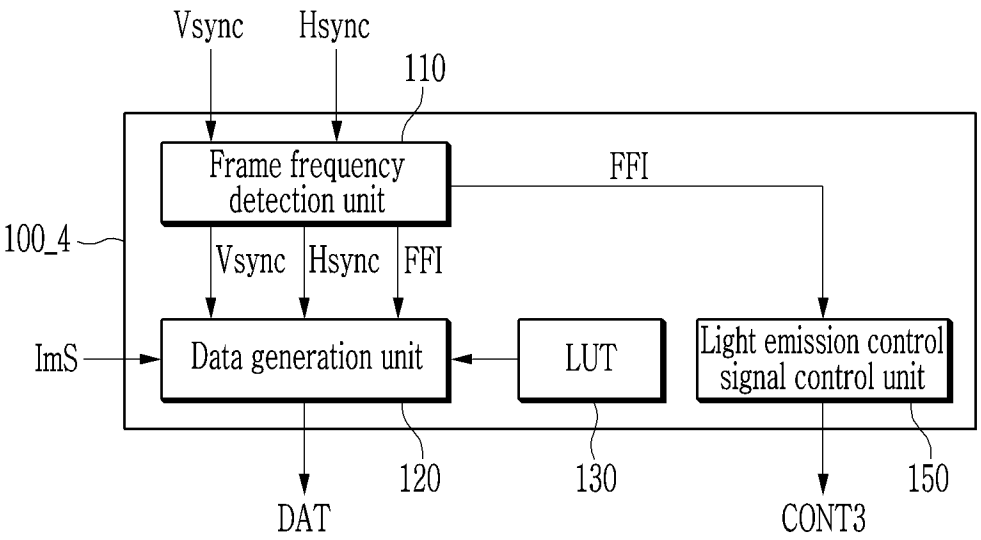
FIG. 15 is a block diagram showing a signal controller according to some exemplary embodiments.

FIG. 15 is a block diagram showing a signal controller according to some exemplary embodiments. FIG. 16 is a flowchart showing a method of driving a display device according to some exemplary embodiments. FIG. 17 is a graph for explaining a method of selectively performing a pulse width modulation dimming method and a data dimming method according to some exemplary embodiments.

Figure 16:
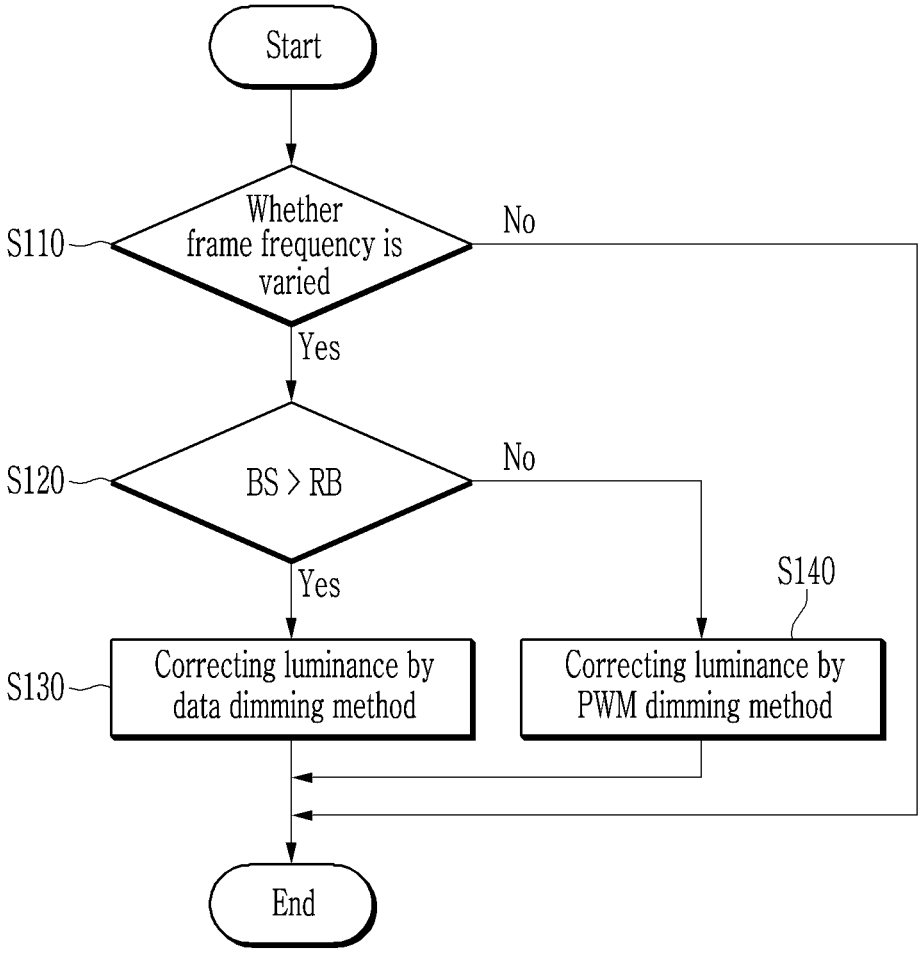
FIG. 16 is a flowchart showing a method of driving a display device according to some exemplary embodiments.
Figure 17:
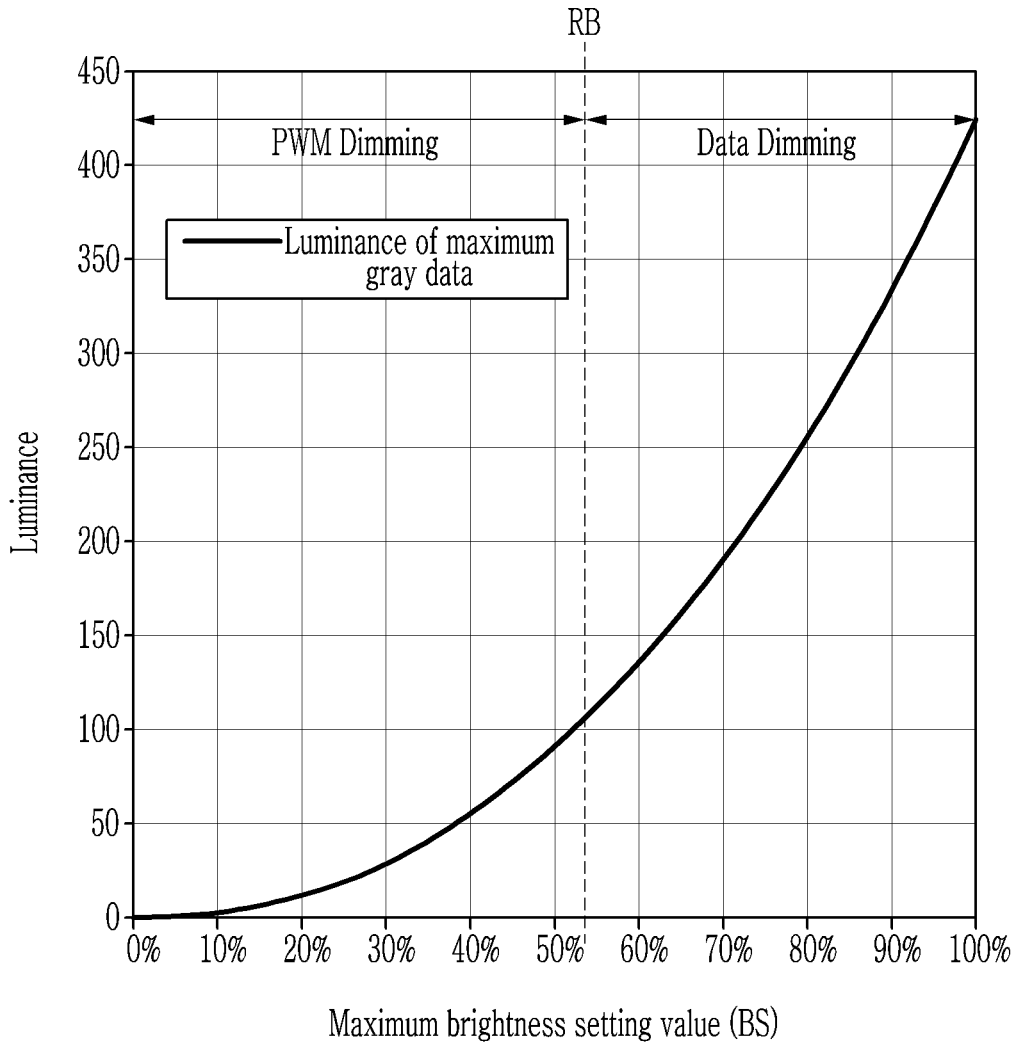
FIG. 17 is a graph for explaining a method of selectively performing a pulse width modulation dimming method and a data dimming method according to some exemplary embodiments.

Referring to FIGS. 15 to 17, the signal controller 100_4 includes the frame frequency detection unit 110, the data generation unit 120, the look-up table 130, and the light emission control signal generation unit 150.

The frame frequency detection unit 110 detects the frame frequency using the vertical synchronization signal Vsync and the horizontal synchronizing signal Hsync, and transmits the frame frequency information FFI to the data generation unit 120 and the light emission control signal generation unit 150.

The signal controller 100_4 may correct the luminance by the data dimming method described in FIGS. 5 to 8 or the PWM dimming method described in FIGS. 10 to 13 according to a maximum brightness setting value BS of the display device. The maximum brightness setting value BS of the display device is a value setting the luminance displayed in the display device corresponding to the data of the maximum gray. As shown in FIG. 17, the luminance for the maximum gray data is increased by adjusting the maximum brightness setting value BS from 0% to 100%.

The signal controller 100_4 corrects the luminance by the data dimming method when the maximum brightness setting value BS is larger than the predetermined reference brightness RB, and corrects the luminance by the PWM dimming method when the maximum brightness setting value BS is less than the reference brightness RB.

As shown in FIG. 16, the signal controller 100_4 determines whether the frame frequency is varied (S110). The signal controller 100_4 may determine whether the frame frequency is varied based on the vertical synchronization signal Vsync and the horizontal synchronizing signal Hsync. Also, as shown in FIG. 4, the signal controller 100_4 may determine whether the frame frequency is varied based on the vertical synchronization signal Vsync and the clock signal CLK.

When the frame frequency is varied, the signal controller 100_4 determines whether the maximum brightness setting value BS is larger than the reference brightness RB (S120).

When the maximum brightness setting value BS is larger than the reference brightness RB, the signal controller 100_4 corrects the luminance by the data dimming method described in FIGS. 5 to 8 (S130). That is, when the image signal ImS includes the gray level of the high gray, the image data signal DAT may be corrected by lowering the gray level of the image data signal DAT. Also, when the image signal ImS includes the gray level of the low gray, the image data signal DAT may be corrected by increasing the gray level of the image data signal DAT.

When the maximum brightness setting value BS is less than the reference brightness RB, the signal controller 100_4 corrects the luminance by the PWM dimming method described in FIGS. 10 to 13 (S140). That is, when the image signal ImS includes the gray level of the high gray, the luminance of the image may be adjusted by decreasing the light emission period in which the light emission signal ELS is applied as the gate-on voltage. Also, when the image signal ImS includes the gray level of the low gray, the luminance of the image may be adjusted by increasing the light emission period.

According to various exemplary embodiments, when the frame frequency is varied, the flicker between the frames may be prevented by correcting the luminance by the data dimming method or the PWM dimming method.

Although certain exemplary embodiments and implementations have been described herein, other embodiments and modifications will be apparent from this description. Accordingly, the inventive concepts are not limited to such embodiments, but rather to the broader scope of the accompanying claims and various obvious modifications and equivalent arrangements as would be apparent to one of ordinary skill in the art.

What is claimed is:

1. A display device comprising:

a frame frequency detector configured to detect a varied frame frequency to generate frame frequency information;

a data generator configured to:

receive an image signal and the frame frequency information;

confirm an expanded frame period exceeding a reference frame period in one frame from the frame frequency information; and correct an image data signal corresponding to the image signal to correspond to a luminance changed according to the expanded frame period;

a data driver configured to output a data voltage corresponding to the image data signal; and a plurality of pixels comprising transistors and being configured to emit luminance corresponding to the data voltage, wherein:

the reference frame period is a period in which the plurality of pixels is configured to emit light with a constant luminance corresponding to the data voltage; and the expanded frame period is a period in which the plurality of pixels is configured to emit light with a changed luminance relative to the reference frame period caused, at least in part, by a leakage current of the transistors.

2. The display device of claim 1, wherein the frame frequency detection unit is configured to:

receive a vertical synchronization signal for dividing the image signal by a frame unit and a horizontal synchronizing signal for dividing the image signal by a gate line unit; and detect the varied frame frequency by counting the horizontal synchronizing signal received until a next vertical synchronization signal is received after the vertical synchronization signal is received.

3. The display device of claim 1, further comprising:

a clock signal generator configured to generate a clock signal, the clock signal comprising an on-voltage and an off-voltage that repeat according to a predetermined cycle, wherein the frame frequency detector is configured to:

receive the clock signal and a vertical synchronization signal for dividing the image signal by a frame unit; and detect the frame frequency by counting the clock signal until a next vertical synchronization signal is received after the vertical synchronization signal is received.

4. The display device of claim 1, wherein, in response to the image signal comprising a gray level of a high gray, the data generator is configured to correct the image data signal by lowering the gray level of the image data signal.

5. The display device of claim 4, wherein the data generator is configured to generate a recovering image data signal that increases a luminance of the image step-by-step through at least one frame following the frame in which the plurality of pixels emit luminance according to the corrected image data signal.

6. The display device of claim 1, wherein, in response to the image signal comprising a gray level of a low gray, the data generator is configured to correct the image data signal by increasing the gray level of the image data signal.

7. The display device of claim 6, wherein the data generator is configured to generate a recovering image data signal that decreases a luminance of the image step-by-step through at least one frame following the frame in which the plurality of pixels emit luminance according to the corrected image data signal.

8. A display device comprising:
a plurality of pixels comprising transistors;
a light emission control driver configured to apply a light emission signal to the plurality of pixels;
a frame frequency detector configured to detect a varied frame frequency to generate frame frequency information; and
a light emission control signal generator configured to:
receive the frame frequency information;
confirm an expanded frame period exceeding a reference frame period in one frame from the frame frequency information; and
adjust a luminance of an image by controlling a pulse width of the light emission signal in correspondence with the luminance that is changed according to the expanded frame period,
wherein:
the reference frame period is a period in which the plurality of pixels is configured to emit light with a constant luminance corresponding to an input data voltage; and
the expanded frame period is a period in which the plurality of pixels is configured to emit light with a changed relative to the reference frame period caused, at least in part, by a leakage current of the transistors.

9. The display device of claim 8, further comprising:
a data generator configured to:
receive an image signal; and
generate an image data signal corresponding to the image signal; and
a data driver configured to generate the data voltage in correspondence with the image data signal,
wherein, in response to the image signal comprising a gray level of a high gray, the light emission control signal generator is configured to adjust a luminance of the image by decreasing a light emission period in which the light emission signal is applied as a gate-on voltage.

10. The display device of claim 9, wherein the light emission control signal generator is configured to control a pulse width of the light emission signal so that the luminance of the image is increased step-by-step through at least one frame following the frame in which the luminance of the image is adjusted by decreasing the light emission period.

11. The display device of claim 10, further comprising:
a data generator configured to:
receive an image signal; and
generate an image data signal corresponding to the image signal; and
a data driver configured to generate the data voltage in correspondence with the image data signal,
wherein, in response to the image signal comprising a gray level of a low gray, the light emission control signal generator is configured to adjust the luminance of the image by increasing a light emission period in which the light emission signal is applied as a gate-on voltage.

12. The display device of claim 11, wherein the light emission control signal generator is configured to control a pulse width of the light emission signal so that the luminance of the image is decreased step-by-step through at least one frame following the frame in which the luminance of the image is adjusted by increasing the light emission period.

13. A display device comprising:
a plurality of pixels comprising transistors;
a frame frequency detector configured to detect a varied frame frequency to generate frame frequency information;
a gamma voltage controller configured to:
receive the frame frequency information;
confirm an expanded frame period exceeding a reference frame period in one frame from the frame frequency information; and
generate a gamma voltage control signal in correspondence with a luminance that is changed according to the expanded frame period;
a gamma voltage generator configured to adjust a level of a reference gamma voltage according to the gamma voltage control signal;
a data generator configured to:
receive an image signal; and
generate an image data signal corresponding to the image signal; and
a data driver configured to:
receive the image data signal and the reference gamma voltage; and
generate a data voltage corresponding to the image data signal based on the reference gamma voltage,
wherein:
the reference frame period is a period in which the plurality of pixels is configured to emit light with a constant luminance corresponding to an input data voltage; and
the expanded frame period is period in which the plurality of pixels is configured to emit light with a changed luminance relative to the reference frame period caused, at least in part, by a leakage current of the transistors.

14. A driving method of a display device, the method comprising:
determining whether a frame frequency is varied;
determining, in response to the frame frequency being varied, whether a maximum brightness setting value setting luminance displayed in a display device corresponding to data of a maximum gray is greater than a predetermined reference brightness; and
correcting, in response to the maximum brightness setting value being larger than the reference brightness, the luminance of an image by a data dimming method for correcting an image data signal corresponding to the luminance that is changed according to an expanded frame period exceeding a reference frame period in one frame, wherein:

the reference frame period is a period in which a plurality of pixels comprising transistors is configured to emit light with a constant luminance corresponding to a data voltage; and the expanded frame period is a period in which the plurality of pixels is configured to emit light with a changed luminance relative to the reference frame period caused, at least in part, by a leakage current of the transistors.

15. The driving method of claim 14, wherein determining whether the frame frequency is varied comprises:

receiving a vertical synchronization signal for dividing the image signal by a frame unit and a horizontal synchronizing signal for dividing the image signal by a gate line unit; and counting the horizontal synchronizing signal until a next vertical synchronization signal is received after the vertical synchronization signal is received to determine whether the frame frequency is varied.

16. The driving method of claim 14, wherein determining whether the frame frequency is varied comprises:

receiving a vertical synchronization signal for dividing the image signal by a frame unit and a clock signal comprising an on-voltage and an off-voltage repeating according to a predetermined cycle; and counting the clock signal until a next vertical synchronization signal is received after the vertical synchronization signal is received to determine whether the frame frequency is varied.

17. The driving method of claim 14, wherein correcting the luminance of the image by the data dimming method comprises:

correcting the image data signal by lowering a gray level of the image data signal in response to the image signal comprising the gray level of a high gray; and correcting the image data signal by increasing the gray level of the image data signal in response to the image signal comprising the gray level of a low gray.

18. The driving method of claim 14, further comprising:

correcting the luminance of the image by a pulse width modulation dimming method for controlling the luminance of the image by controlling a pulse width of a light emission signal applied to a plurality of pixels of the display device in correspondence with the luminance that is changed according to the expanded frame period in response to the maximum brightness setting value of the display device being less than the reference brightness.

19. The driving method of claim 18, wherein correcting the luminance of the image by the pulse width modulation dimming method comprises:

adjusting the luminance of the image by decreasing a light emission period of which the light emission signal is applied as the gate-on voltage in responds to the image signal comprising a gray level of a high gray; and adjusting the luminance of the image by increasing the light emission period in response to the image signal comprising the gray level of a low gray.

* * * * *